US006609637B1

(12) United States Patent
Suffa

(10) Patent No.: US 6,609,637 B1
(45) Date of Patent: Aug. 26, 2003

(54) CLOSURE CAP INTERACTING WITH A BOTTLE RECEPTACLE

(75) Inventor: Udo Suffa, Gefell (DE)

(73) Assignee: Alpla Weke Alwin Lehner GmbH & Co.KG, Hard (AT)

( * ) Notice: Subject to any disclaimer, the term of this patent is extended or adjusted under 35 U.S.C. 154(b) by 0 days.

(21) Appl. No.: 09/530,474

(22) PCT Filed: Oct. 26, 1998

(86) PCT No.: PCT/EP98/06781

§ 371 (c)(1),
(2), (4) Date: Jul. 11, 2000

(87) PCT Pub. No.: WO99/21772

PCT Pub. Date: May 6, 1999

(30) Foreign Application Priority Data

| | | |
|---|---|---|
| Oct. 28, 1997 | (DE) | 197 47 426 |
| Feb. 3, 1998 | (DE) | 198 04 052 |
| Apr. 6, 1998 | (DE) | 198 15 307 |
| Jun. 3, 1998 | (DE) | 198 24 714 |

(51) Int. Cl.[7] ..... B65D 47/00
(52) U.S. Cl. ..... 222/545; 215/216; 215/219
(58) Field of Search ..... 222/570, 153.1, 222/556, 545; 215/224, 225, 235, 237, 317, 321, 216, 219; 220/784

(56) References Cited

U.S. PATENT DOCUMENTS

| | | | | |
|---|---|---|---|---|
| 3,820,683 A | * | 6/1974 | Jasinski | 220/784 |
| 5,544,778 A | | 8/1996 | Goncalves | |
| 5,687,863 A | * | 11/1997 | Kusz | 215/216 |
| 6,039,197 A | * | 3/2000 | Braun | 215/228 |

FOREIGN PATENT DOCUMENTS

| | | |
|---|---|---|
| BE | 875827 | 10/1979 |
| DE | 3345350 | 6/1985 |
| DE | 3530373 | 2/1987 |
| DE | 4206123 | 11/1992 |
| DE | 19505805 | 8/1996 |
| DE | 29509062 | 9/1996 |
| DE | 29615425 | 1/1998 |
| EP | 0504620 | 9/1992 |
| EP | 0787660 | 8/1997 |
| FR | 2275374 | 1/1976 |
| GB | 947126 | 1/1964 |
| GB | 2053866 | 2/1981 |

* cited by examiner

*Primary Examiner*—Kevin Shaver
*Assistant Examiner*—Stephanie Willatt
(74) *Attorney, Agent, or Firm*—Martin A. Farber

(57) ABSTRACT

A closure cap for closing the opening of a bottle container. A neck of the bottle container includes a latching projection. The closure cap includes a latching arm attached to a ring (R), which circumferentially encircles the neck of the bottle container underneath the latching projection. The ring (R) includes a length store (L) and an undergripping projection. The length store allows the ring (R) to be flexed so that the diameter of the ring is large enough to pass over the latching projection. The undergripping projection is located on the upper side of the ring and sits against the latching projection when the ring (R) is in an unflexed position.

6 Claims, 32 Drawing Sheets

6
V
1
29
5
12
5
15
α
16
15
7
8
R

25
V
27
27
VIII
1
R
16
7
z
z
19
28
5
15
A
A
15
18
18
5
15
15
19
z
z
VII
VII
29
16
VIII 7
8
9
5
15
16
28
y
29
2
x
D
x
26
12
14
R
25
6
2
5
4
15
10
11
1
V
3

1
6
44
44'
52
53
56
57
V
E
51
31
51
55
14
50
43
45
58
46
49
47
30
53
59
48
48
2
12
15
33
7
33
61
15
61
63
63
8
9
62
64
10
11
16
64
62
3
x
x
R
S

CLOSURE CAP INTERACTING WITH A BOTTLE RECEPTACLE

FIELD AND BACKGROUND OF THE INVENTION

The invention relates to a closure cap interacting with a bottle container, a latching projection being provided on the bottle container and a latching arm being provided on the closure cap together with an undergripping projection for interacting with the latching projection.

A closure cap of this type, which can be latched to the neck of a bottle container, is disclosed by DE-C 33 45 350. In this, the latching arm, which is arranged as a pair, is formed by snap-in fingers which extend from the top of the closure cap and continue on the neck side into each undergripping projection. The back of the two latching arms is supported by moulded-on strips. The webs are rooted in the inner of a dome. wall of the closure cap which is shaped in the manner

SUMMARY OF THE INVENTION

It is an object of the invention to provide a closure cap which is of the type in question, can be connected to a bottle container and which latches securely, despite use of a construction which saves on materials to a maximal extent.

This object is first and foremost achieved in the case of a closure cap together with a bottle container having the features of claim 1, in which it is provided that the undergripping projection is provided on a circumferentially encircling ring which, in the circumferential direction, has a length store which is sufficient to overrun the latching projection and is useable with elastic resetting. A ring of this type can spring up as a neck loop. Having passed over the latching projection, which is generally formed by an annular bead, of the bottle container, the ring, by partially using to completely exhausting the length store, briefly proceeds towards the ideal circumferential structure in order then to constrict again under the action, which is then released, of the return force of the ring. All this can be achieved with the ring wall being of maximum thinness. This signifies a saving in material. Its relatively large constructional extent runs, of course, in the plug-in direction. A long rectangular cross section of a ring of this type is sufficient to reliably pass over the latching projection provided on a bottle neck having a discharge opening. If no control means are provided, latching to the bottle neck and the bottle container, respectively, is then irreversible. Provision is furthermore made for the latching arm to run substantially parallel to a central axis of the discharge opening. This permits the transmission of sufficient springing-up forces. A particularly stable latching arm is achieved if the latter participates in the annular shape. An advantageous solution is achieved if two substantially mutually opposite latching arms are provided. The length store is achieved in simple manner on account of a wavy formation of the ring. In this arrangement, it suffices if only part of the ring is undulated in the circumferential direction. However, that zone of the length store which deviates from a normal circular/annular contour can also be realised by the length store being provided by a resilient capability in the region of connection to the latching arm of the ring. This applies correspondingly to both latching arms, to be precise on both sides. Provision is furthermore made for the ring to run substantially perpendicularly with respect to the latching arms. Alternatively, a solution is also conceivable and advantageous according to which the ring encloses an acute angle with the latching arms in a lateral projection. In this arrangement, it is furthermore of advantage for the ring which runs at an acute angle to consist of two substantially opposite sections covering the same height range. In this solution, there is the basis of the control indicated above if the closure cap is to be reversibly associated with the bottle container. Accordingly, the latching projection on the bottle container is then formed as a mating thread. The mating thread can likewise be passed over by spring action, but, on the other hand, provides the possibility of screwing the cap down and unscrewing it. There is preferably a steep thread, preferentially a two-start thread. In this arrangement, the resultant interruption to the corresponding threads can furthermore advantageously be used to the effect that an end surface, facing in the circumferential direction, of one thread interacts with a stop surface provided on the ring or the latching arm. This can be used as a screwing-down limit. The end surface merely needs to be arranged such that it is sufficiently steep. The said stop surface on the inside of the latching arm is realised in the form of a substantially vertically extending stop strip. This is moulded onto the latching arm and has a stiffening effect on it, providing a type of T-profile even with a short T-web. Furthermore, by means of a bent portion facing away from the circumferential direction, the ring is provided with a stop surface which secures against self-releasing unscrewing. In advantageous manner, said bent portion is provided on the latching arm of the ring. It can likewise interact with a corresponding mating surface of the thread. However, it is specifically preferred for the stop surface to be provided on a separate stop projection of the bottle container. The projection is expediently located in the region of the screwing-down end position. In addition, it has proven advantageous in this arrangement for the stop surface to be aligned in such a manner that a forced overrunning and elastic deflection of the ring is made possible. The return path therefore becomes free for intentional unscrewing of the closure cap. Provision is moreover made in this arrangement for the stop projection to have a bevel which can be overrun in the screwing-down direction of the closure cap. If the irreversible variant is resorted to, the stop surface merely needs to lie transversely with respect to the direction of rotation of the closure cap, i.e., for example, to face radially towards the geometrical rotational axis. Even a hooking undercut can be used. Furthermore, on a closure cap of the type in question, in which the closure cap has a central collar for engaging in a discharge opening of the bottle container, it is above all advantageous in terms of fitting for the collar to have a lead-in bevel for interacting with a rim of the discharge opening. The lead-in bevel, which is, for example, rotationally symmetrical, provides an effective means for precentring with respect to the edge. When docking the two parts, a collision therefore no longer happens so easily when the component to be fitted is not applied linearly. Even a relatively slight tapering, on the external edge, of the free end of the collar suffices. It is therefore already virtually sufficient if the lead-in bevel extends inwards at least by the extent of one wall thickness of the collar. In any case, one is on the safe side if the lead-in bevel has a dimension which is a multiple of the wall thickness of the collar. This may amount to as much as five times. It is advantageous if the lead-in bevel is formed from a plurality of separate lead-in tongues. The latter have a rounded portion typical of tongues and can also, in terms of the wall, lip out towards the free end. As has been found, four lead-in tongues distributed at equal angular spacings are sufficient. A contribution on the container towards the corresponding centring of the elements to be connected by plugging-in techniques consists in the inner edges of the rim of the bottle neck being chamfered. The invention furthermore proposes that in the case of a completely closed construction, the closure cap has a separately arranged covering part on the outside. The latter may be a carrier of information etc. For the selection of colour etc., it is favourable for the covering part to be latch-mounted on the closure cap. With regard to the dome-shaped or flat dome-shaped form of the closure cap, it is of advantage for the covering part to be formed in the manner of a spherical cap. A good connection base is provided if the closure cap is formed to have a flat surface in the region of the covering part. In order, in this arrangement, to avoid cutting peripheral edges with respect to the covering part, it is furthermore proposed for the flat surfaced region to be recessed within the contour dimension of the covering part. The covering part does not therefore need an edge finish in this regard. It is furthermore proposed that the stop strip be formed directly by a stop surface of the latching arm and that it interact with a neck strip, acting as a counter stop, at the base of the bottle neck as a rotation-limiting stop in the screwing-down direction. A counter stop with quite a large surface area can be produced here, which counter stop, in any case, is located above the useable surface extent of the end surface of a thread. In order, furthermore, to use the neck strip at the same time also in a thread-forming manner, it is proposed for the back of the neck strip to run correspondingly aligned with the extent of the thread of the latching projection. This also increases the stability of the neck strip, which can furthermore be arranged as a pair. Increasing stability with regard to the stop strip is a measure to the effect that the back of the latching arm and of the stop strip, respectively, is stiffened by a ridge strip. The latter can be rooted in a virtually T-profile-like manner in the inner wall of the closure cap. Alternative means for securing against self-releasing unscrewing resides in a combination of features to the effect that the closure cap, on the inside, has a spring-elastic edge wing which, in the screw-on end position, grips edge ribs of the bottle container from behind in a latching manner and thus secures the closure cap against self-releasing unlocking. This means for securing against self-releasing unlocking of the closure cap is also expediently formed as a pair. An advantageous development is then produced by the edge wing which overruns the boundary ribs in a latching manner being rooted in the inner wall of the closure cap. It is thus connected in a manner such that it is stable under load. However, fixing over a partial length is sufficient here, i.e. the edge wing is not connected over its entire vertical length to the inner wall, this being done with a free resilient tongue being formed towards the edge rib. A clearance of this type reinforces the springing-over component when moving over the boundary ribs. The user is given a clearly audible signal of movement into and out of the end position. It suffices if the tongue has a length of at least the height of the edge rib. For fitting of the closure and latching over of the ring, it has proven useful for that section of the ring which grips under the latching projection in a hooking manner to be arranged obliquely with respect to the central axis. This results in a catch funnel acting in a centring manner and permits the latching projection to be overrun with very slight effort. In the present constructional conditions, it is advantageous for the angle used to amount to approximately 20°. An advantageous refinement is furthermore achieved by a rhomboidal cross section of the undergripping sections. In this arrangement, it is advantageous for the undergripping projection to taper out in the vicinity of the bottle neck and for the end facing away from the undergripping projection to taper out outside the edge of the latching projection. This renders the undergripping projection in the manner of a cutting edge. In addition, the rear hooking force component which is directed towards the center is increased. This makes an overall improvement in the retaining ability and the firm fit of the closure on the bottle container. In order, in spite of the discharge opening of the bottle neck of the container being relatively large in cross section and therefore favourable for filling, also to be able to use the container as a spray-jet dispenser, it is proposed, in an advantageous development of the invention, that there be associated with the bottle neck a spray insert which can be closed by the closure cap and is in the form of an intermediate cap. As seen in terms of cross section, an intermediate cap of this type has therefore an adapter function. In spite of the wall thickness having been reduced to the greatest possible extent, the cap form provides sufficient stability when put on. The spring action arrangement can be used. In this arrangement, the intermediate cap stiffens the head-end region of the bottle neck, which, for its part, stiffens the intermediate cap in turn. In advantageous manner, the intermediate cap is latched to the rim of the bottle neck. An exterior latching is preferably used, characterised by an outwardly directed latching bead on the rim of the bottle neck. Accordingly, the latching lugs are located on the inside of the intermediate-cap rim. They grip, with a steep flank, under the corresponding lower flank of the rim bead. Of course, latching lugs of this type have a back which can be overrun. Furthermore, the latching lugs are cut freely in the back in the manner of windows. This furthers their ability to deflect radially outwards. It is favourable if four latching lugs are provided, disposed distributed at equal angular spacings. It is further proposed for the intermediate cap to have a centrally located spray spout. There is thus no need for a particular angular alignment. Furthermore, one feature comprises the spray spout being closeable by a stopper of the closure cap. In this case, it is advantageous if the stopper is surrounded by a spray-spout centring shaft, defined by radial strips rooted in the top of the closure cap. The latter structure, which can be executed such that it has fairly thin walls, saves on material and in spite of this provides this zone of the dispenser, which zone is particularly stressed mechanically, with satisfactory stability. In order to provide the radial strips, which are aligned in the manner of spokes, with a position which is especially also useful for the ejection, it is furthermore proposed for the radial strips in the back to be connected by an annular wall which is likewise rooted in the top. In addition, an annular wall of this type stabilises the top itself. Provision is furthermore made for the intermediate cap to have a collar, for inserting it in a sealing manner into the discharge opening of the bottle neck. In order to ensure a tilt-free to even self-positioning placement of this exposed part, the collar has a lead-in bevel, formed from lead-in tongues, as have already been explained above in connection with one variant. A refinement of even independent significance resides then in a ring-related development by the legs of the sections of the ring being rooted in the wall of the closure cap. The sections therefore spring directly from the inner wall of the closure cap whose wall sections are included in the annular structure. In extension store terms, the back region between two respective sections which are rooted in the wall is a reservoir between the legs of the sections (cf. FIG. 1). As far as safety in use is concerned, a contribution is made by blocking cams of a child-proof lock, which blocking cams are located in the vicinity of the rim of the wall of the closure cap and interact with mating cams which are located at the base of the bottle neck and can be overrun in the closing direction. By stressing those portions of the wall which are remote from the blocking cams, there is effected the release of the blocking cams from the region of action of the mating cams.

BRIEF DESCRIPTION OF THE DRAWINGS

The subject-matter of the invention is explained in more detail below with reference to an exemplary embodiment illustrated with drawings. In the drawings.

DETAILED DESCRIPTION OF THE PREFERRED EMBODIMENT

Figure 1:
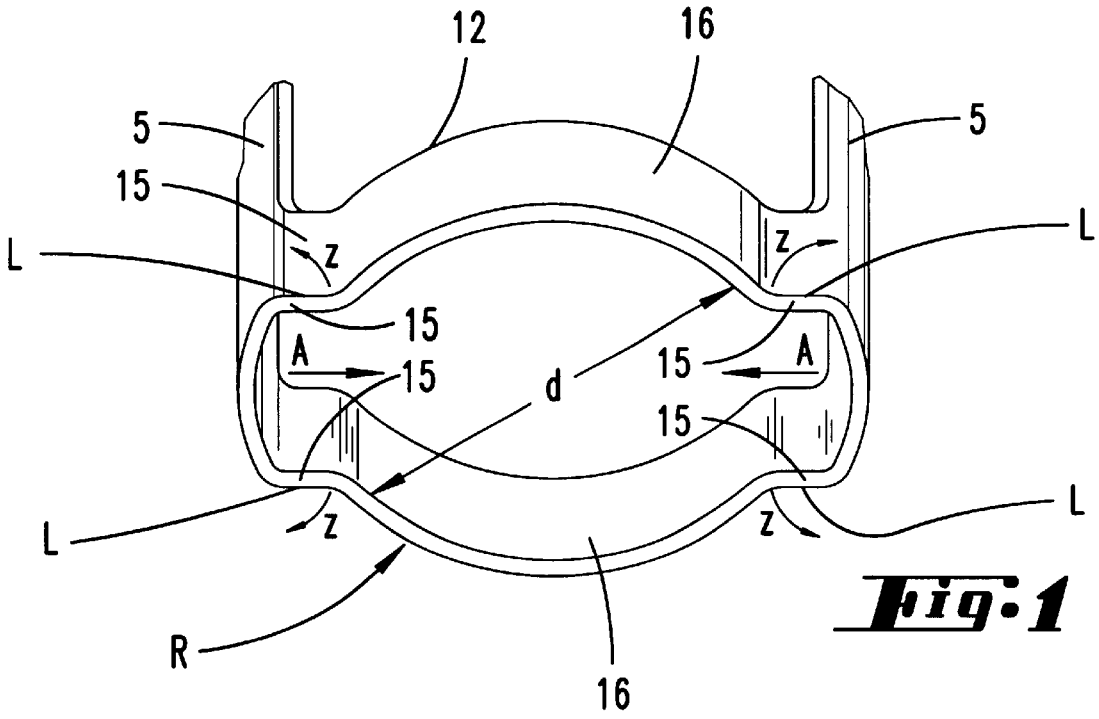
FIG. 1 shows the ring forming, in terms of latching, the core of the closure cap, in an illustration giving a worm's-eye view.

The illustrated closure V of a dispenser or binding comprises a closure cap 1 which can be associated with a neck 2 of a bottle container 3.

The two parts are produced with maximally thin walls, one as an injection-moulded part, the other as a blow-moulded part. In addition, from the point of view of process safety during the assembly, the two parts are formed such that they are stable, especially with regard to the latching means realised here. Even bottle containers manufactured by preform production technology correspond to the requirement for thin walls. The presented latching closure means according to the invention is very well suited for preform bottle containers of this type.

On the closure-cap side, the latching means consist of a ring R and, on the bottle-container side, consist of a latching projection 4.

The latching projection 4 is seated on the circumferential wall of the bottle neck 2. With regard to the latching projection 4, there is in question an annular bead encircling in a continuous or interrupted manner. Its upper flank falls outwards and obliquely in the direction of the bottle container 3. The lower flank is arranged steeply, i.e. it extends substantially horizontally, i.e. perpendicularly, with respect to a vertically aligned longitudinal central axis x—x of the bottle neck 2.

The ring R is carried by two latching arms 5. These are vertically orientated strips. They extend from a top 6 of the closure V. The top 6 continues via a wall falling down on all sides into a dome-shaped body. Its end edge 8 is seated on a peripheral shoulder 9 of the bottle container 3. The flat cone-like base or plateau 10 rises above the shoulder 9. The abovementioned bottle neck 2 develops from this base or plateau. The edge 11 of the plateau, which edge falls away steeply towards the shoulder 9, is adapted to the elliptical or oval edge contour of the dome-shaped body 7. As a consequence of internal engagement, this produces an acceptable means of rotationally securing the closure cap 1 relative to the bottle container 3. The closure cap is flattened, as is the bottle container 3. This ensures a congruent position of the two parts with respect to each other.

The upper side of the ring R forms an undergripping projection 12 for interacting with the latching projection 4, more precisely with its lower flank.

The ring R is realised as a closed, axial band contour in the manner of a pipe section. The band has a substantially rectangular cross section. The longer side of the band lies in the putting-on direction arrow y of the closure cap 1. Like the upper flank of the latching projection 4, in some solutions the undergripping projection 12 is, as illustrated, bevelled. This is of benefit to easing springing-up action.

In the basic position, the ring R has an internal diameter D which substantially corresponds to the external diameter D of the bottle neck 2 in the latching region of the ring R. The ring R moreover has sections which are larger than its internal diameter d. These sections provide a length store L. The length store L is dimensioned in such a manner that the ring R can expand counter to its own restoring force. This state occurs if the ring R has to pass over the latching projection 4, which has a larger external diameter than d, which occurs in the course of the springing-up action.

Figure 2:
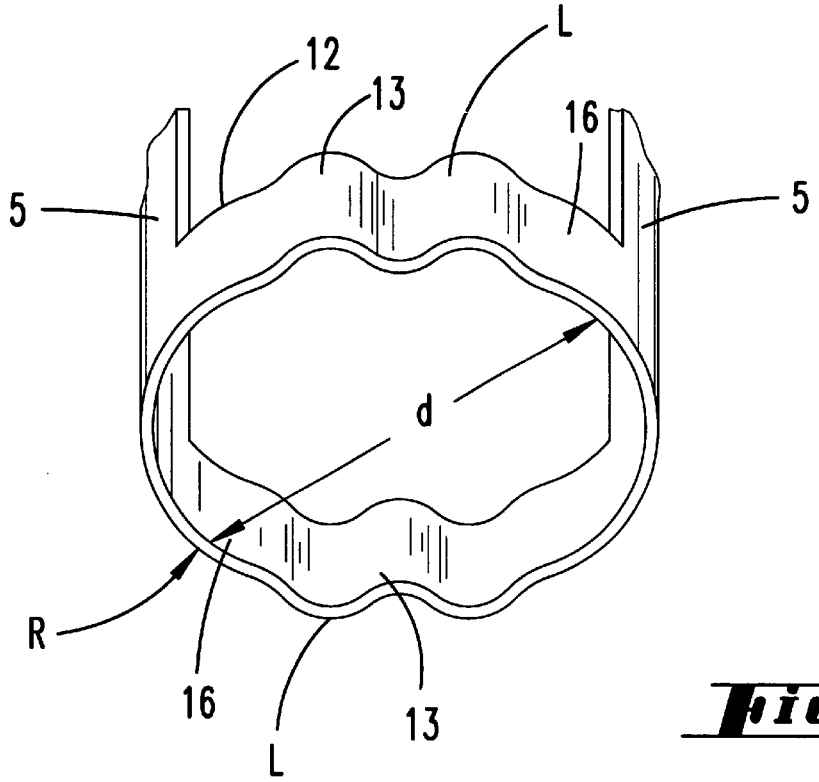
FIG. 2 shows, in an identical illustration, a modified solution with regard to the means forming the length store.
Figure 3:
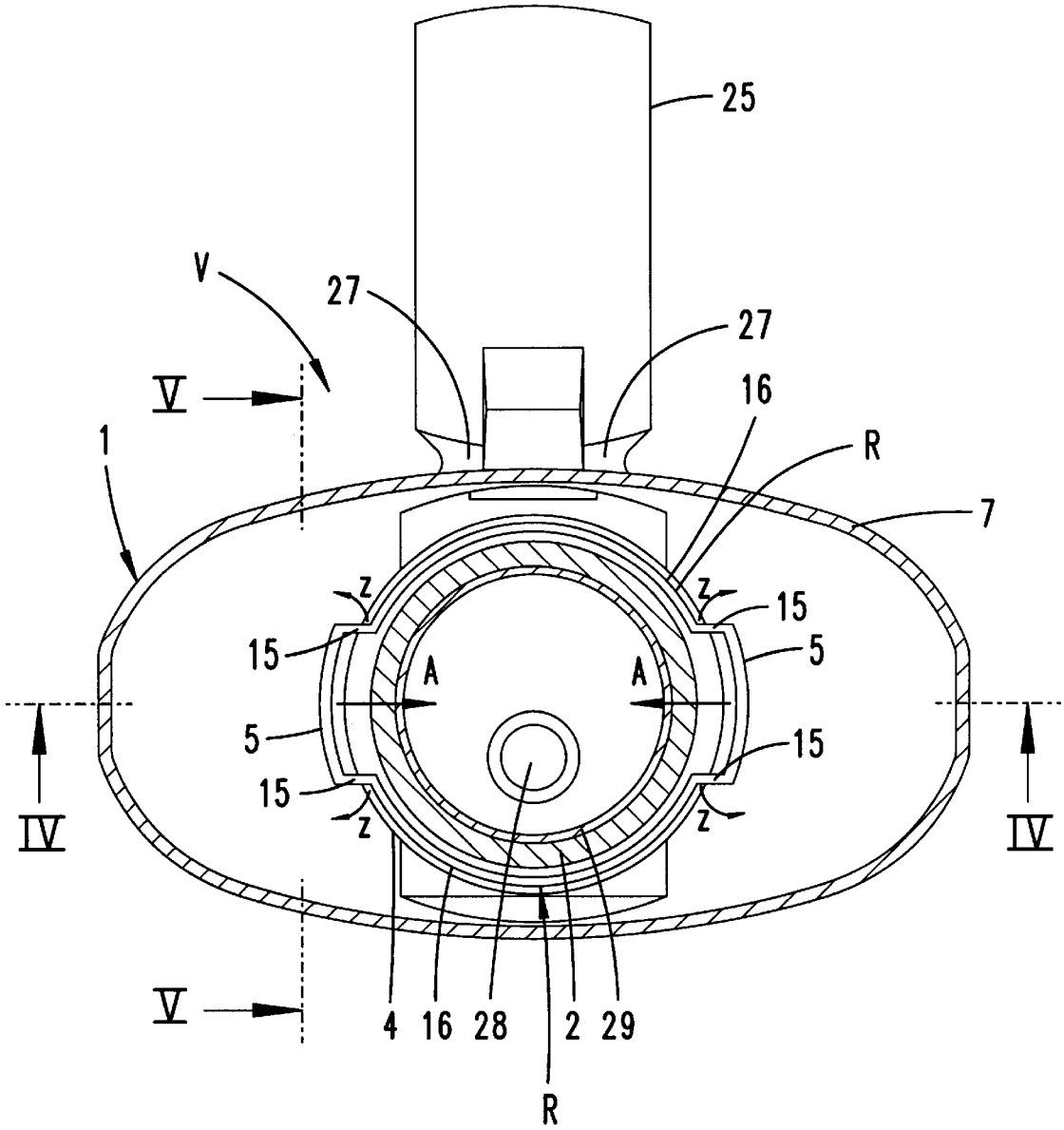
FIG. 3 shows the closure cap in cross section, in its latched position, with the neck of the bottle container also in section.

The length store L is achieved in the case of the ring R, illustrated in FIG. 2, on account of a wavy formation of the ring R. The undulation is denoted there by 13. The wave crests, which extend outwards, can be realised as bulges which exceed a circular annular shape. However, as illustrated, it may also be effected in such a manner that the wave amplitude equally turns out to form the ideal circular shape. In every case, the undulation 13 is such that the undergripping projection 12, in the circumferential direction, constitutes a length store L which is sufficient to overrun the latching projection 4 and which, after the corresponding "obstacle" has been passed over, resets itself again with the latching connection aimed for being realised.

In the case of the basic version of the ring R, which is illustrated in FIG. 1, the length store L is situated in the ring-side extension region of the latching arms 5, which latching arms 5 are themselves also curved in the shape of a section of a circular ring, but lying on another, larger diameter level. In terms of cross section, they run substantially rotationally parallel to the longitudinal central axis x—x of the neck 2 and of its neck cavity or discharge opening 14, respectively. The curvature results in very stable arms 5.

As can be gathered from FIG. 1, in the region of the connection of the latching arms 5 via legs 15, the band continues into the legs. The band forms a type of bay-like bulge there. The legs 15 are aligned substantially parallel. The transitions may, as is illustrated, be slightly rounded. The length store L, which is also produced here, as in the case of the undulation 13, has an identical spring-back capability, on account of the change in direction of parts of the band. The spring-back direction of the two legs 15, which directions point away from one another, is indicated by arrow z. The legs 15 act as hinged tabs.

This leads in an overlapping manner to a radially inwardly extending convergence of the lower ends, forming the band, of the latching arms 5. This direction of movement is shown by arrow A.

The length store L could be increased, if required, by the legs 15, which run substantially parallel to one another in the basic position in the case of the exemplary embodiment, being aligned in the direction of extent such that they converge inwards.

Figure 5:
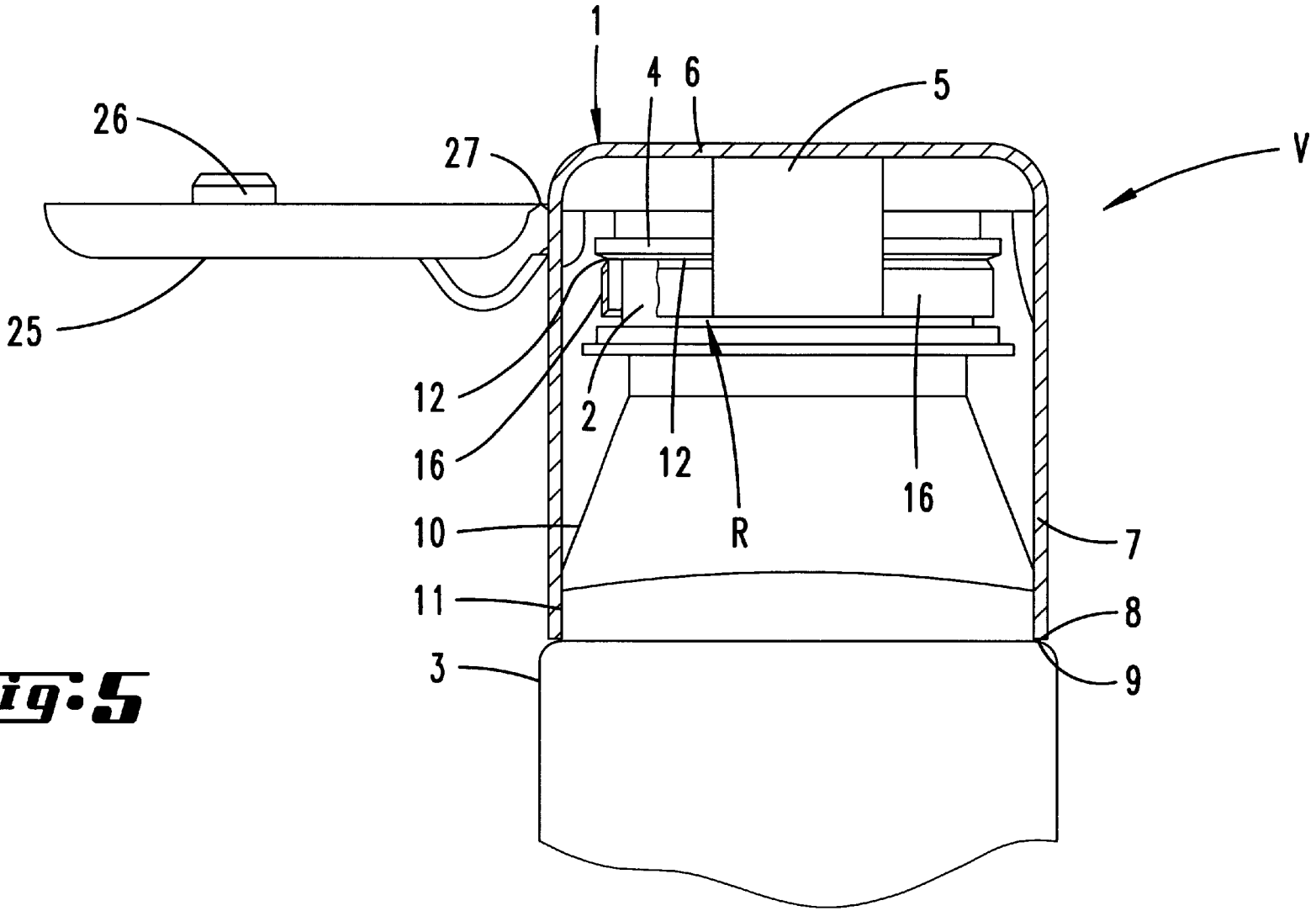
FIG. 5 shows the section according to line V—V in FIG. 3 with the ring only partially cut away.
Figure 6:
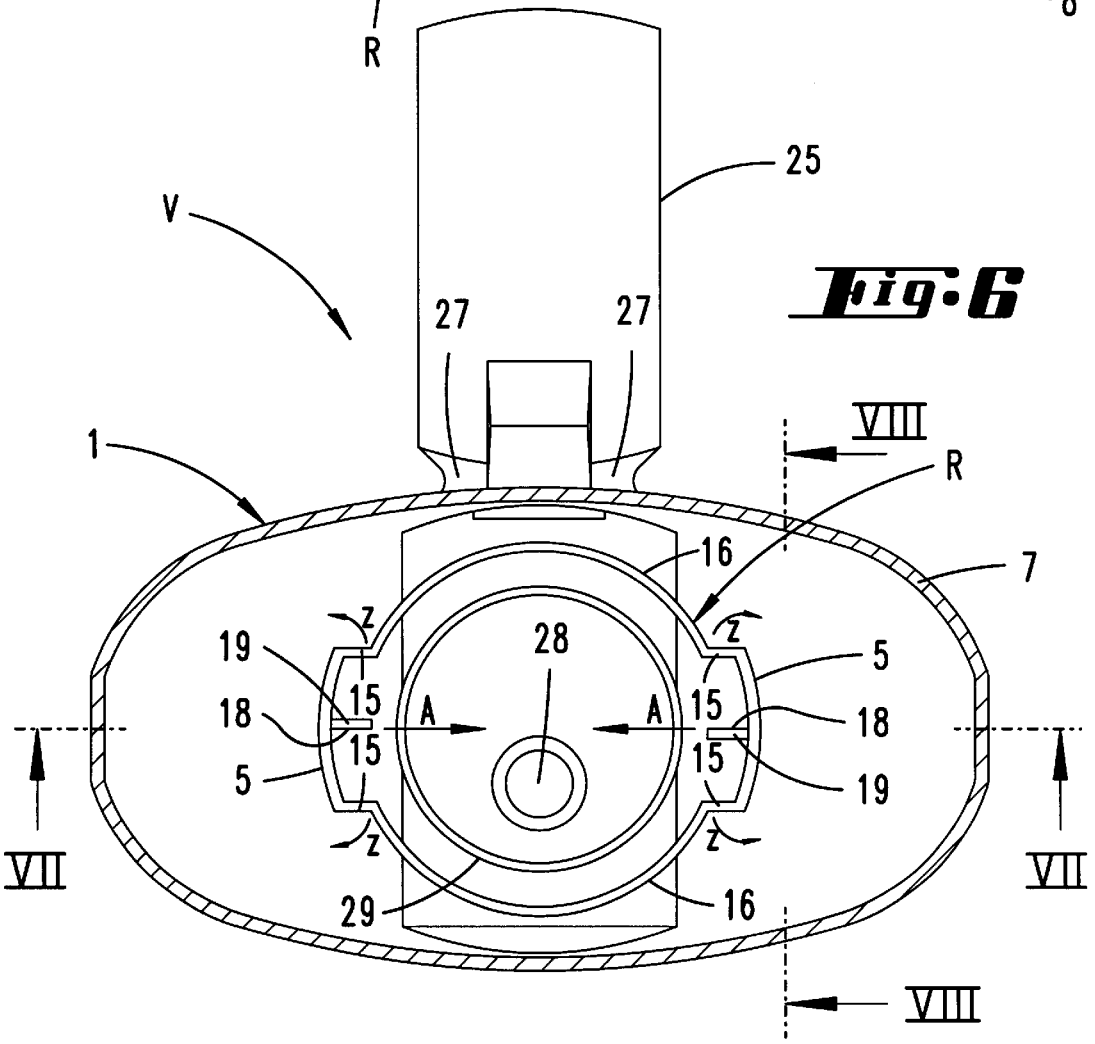
FIG. 6 shows a sectional illustration corresponding to FIG. 3, showing a modified form of the ring, with the bottle container omitted.
Figure 8:
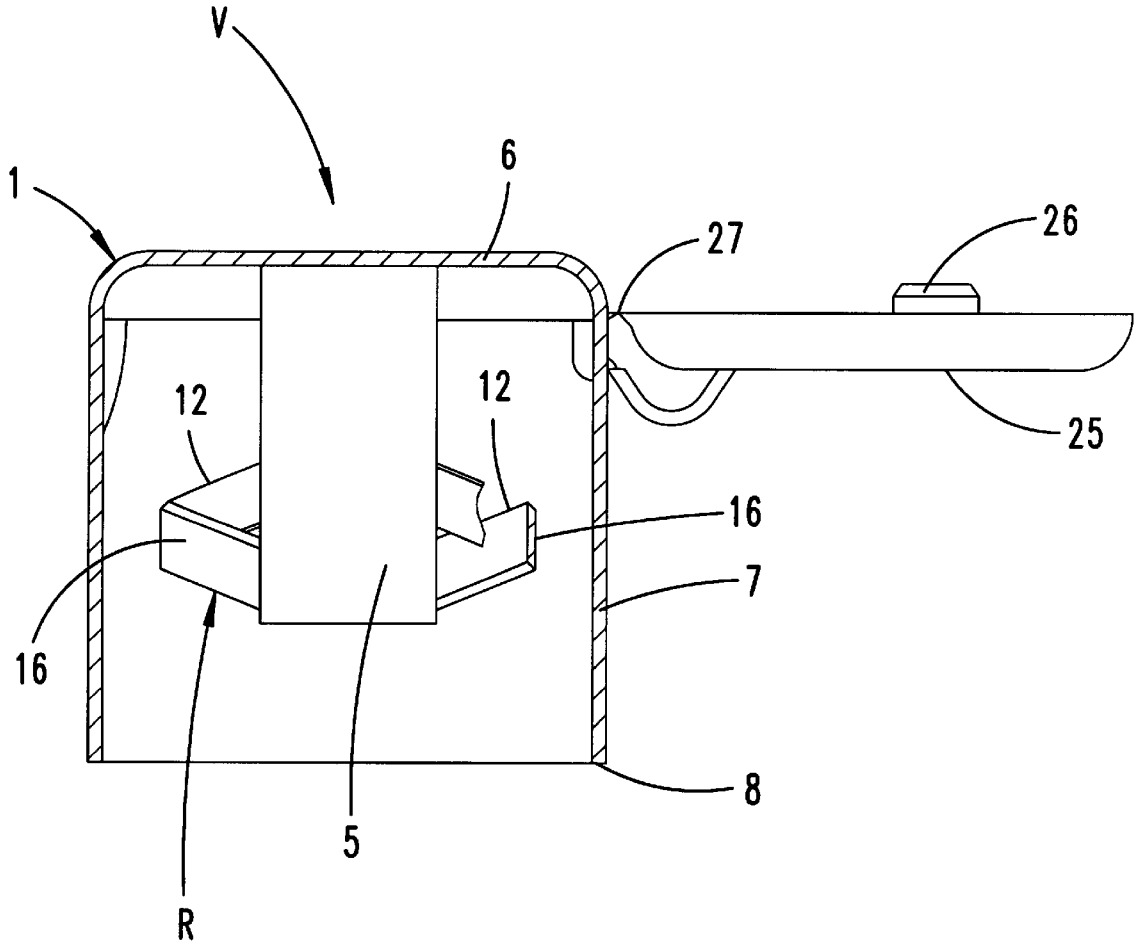
FIG. 8 shows the section according to line VIII—VIII in FIG. 6, again with the ring partially broken open.

Whereas the basic version of the ring R (FIGS. 1–5 and 16) has an alignment which lies substantially perpendicularly with respect to the direction of extent of the latching arms 5, the ring R starting from FIG. 6 is arranged obliquely. The latching projection 4 runs in a corresponding manner. The ring R encloses an acute angle alpha of approximately 20° with the latching arms 5 in a lateral projection. The rising profile only begins in the transition region between the leg 15 and the adjacent, substantially circular section 16 of the band, or more precisely ring R. In this respect, the ring R, which runs at the acute angle, consists of two substantially opposite circular arc-shaped sections 16. These extend over the same height range.

The height range is defined by the upper and lower end of the latching projection 4, which is arranged obliquely there.

The latching projection 4 is formed on the bottle neck 2 of this bottle container 3 as a thread. The thread is a two-start thread.

Figure 10:
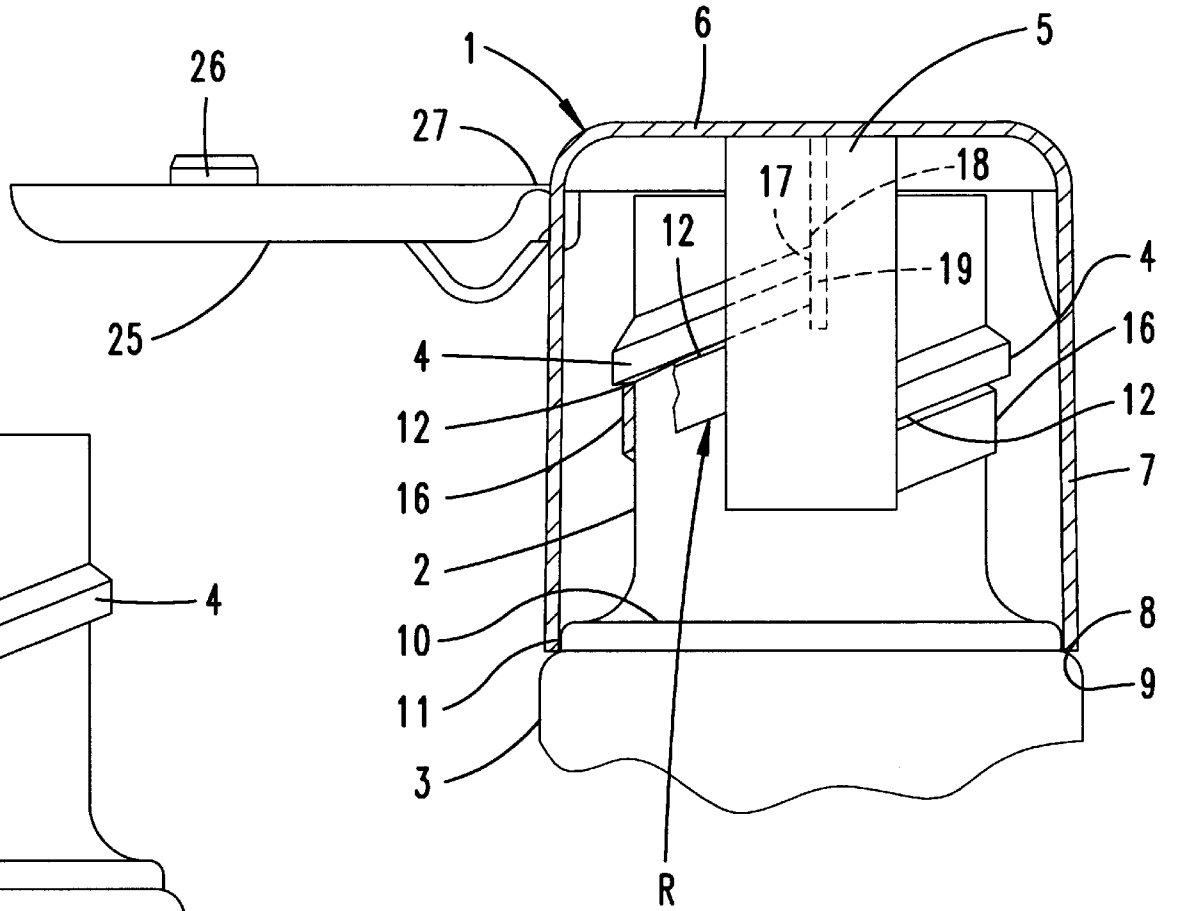
FIG. 10 shows an illustration corresponding to FIG. 5, showing a stop strip limiting the screwing down.
Figure 9:
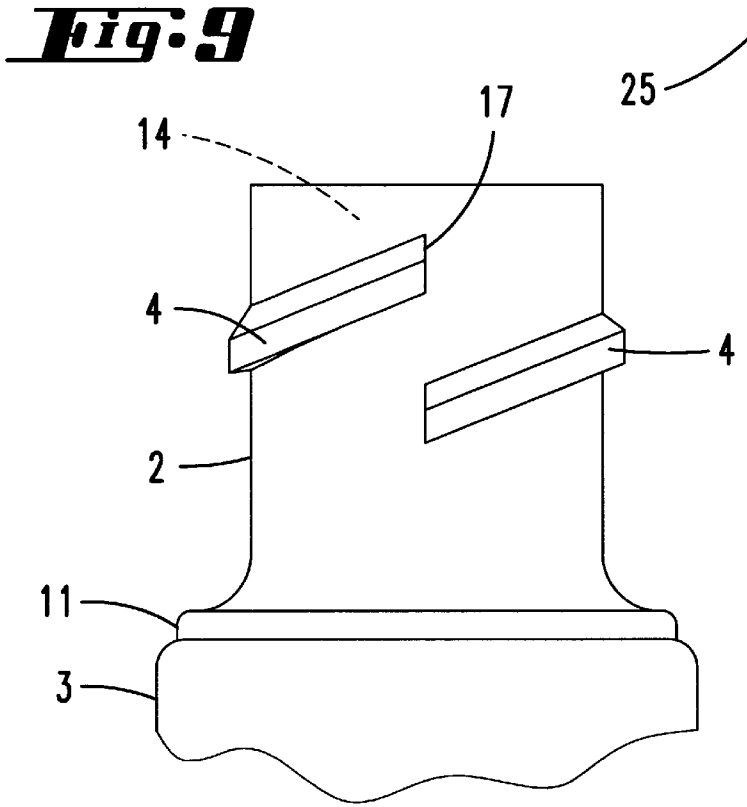
FIG. 9 shows the neck region of the bottle container, which region is provided here with a thread.
Figure 11:
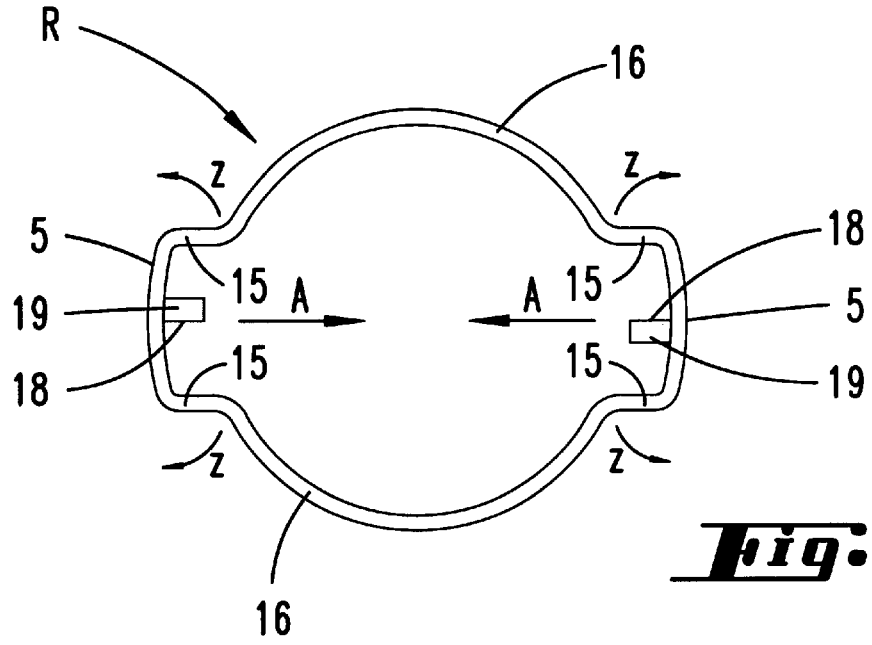
FIG. 11 shows the ring in isolated representation showing both stop strips.
Figure 12:
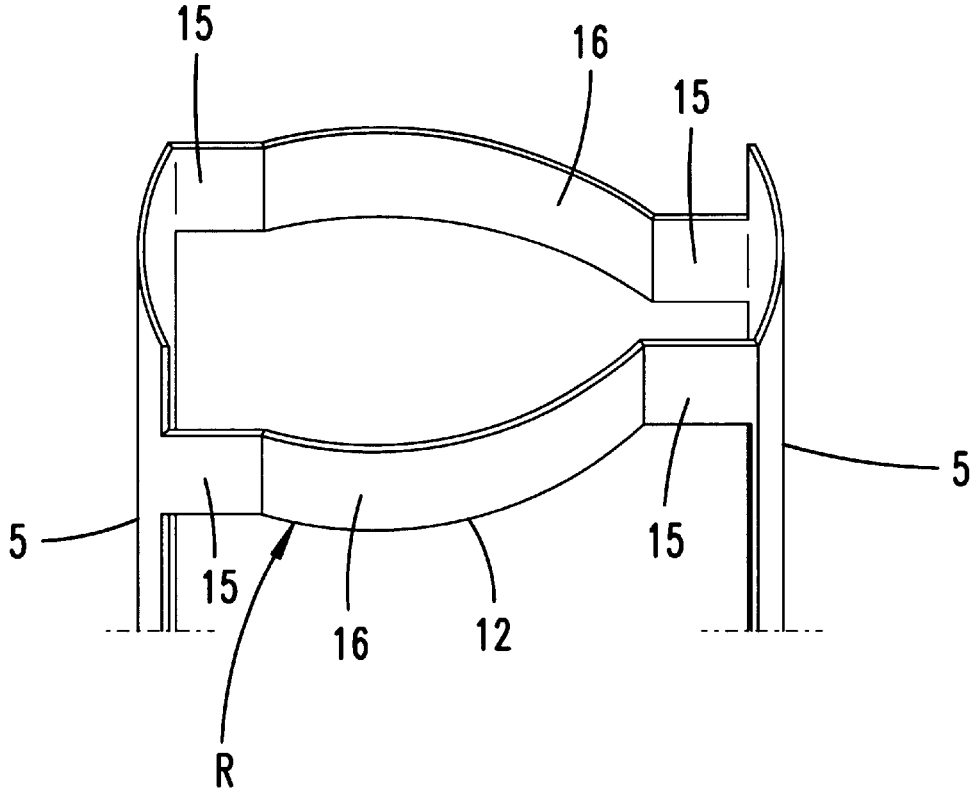
FIG. 12 shows, in a perspective illustration, the ring with the extent of its annular sections matching the thread.

The said thread is simultaneously used as a rotation-limiting stop for the closure cap 1 to be put on using screwing technology. Reference should be made to FIG. 10. It can be seen there that an end flank 17, facing in the circumferential direction, of the one thread, also declared here as the latching projection 4, interacts with a stop surface 18 formed on the ring R or the latching arm 5. In the exemplary embodiment illustrated, the stop surface 18 is situated on a stop strip 19 moulded onto the inside of the latching arm 5. The stop strip extends vertically. It is pushed out of the longitudinal center of the latching arm 5, so that the actual stop surface 18 runs symmetrically. The vertically aligned stop strip 19 extends from the top 6 of the closure cap 1. The two latching arms 5 are provided with a stop strip 19, so that the two threads, i.e. their end surface 17 lying closer to the opening edge of the discharge opening 14, can.be used in the manner outlined. This results in a balanced end-stop effect. The ring R is therefore not easily distorted.

Figure 13:
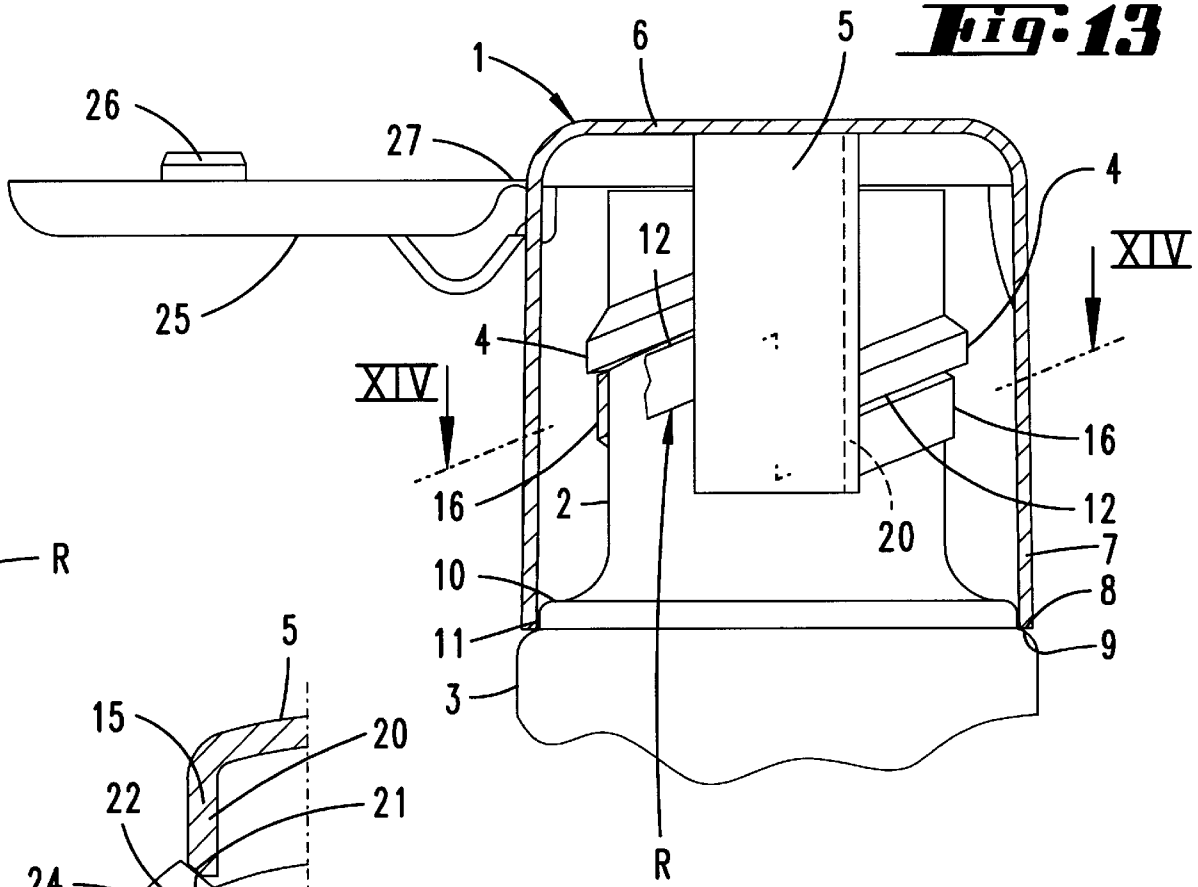
FIG. 13 shows an illustration corresponding to FIG. 5, modified further with illustration of means preventing self-releasing unscrewing.
Figure 15:
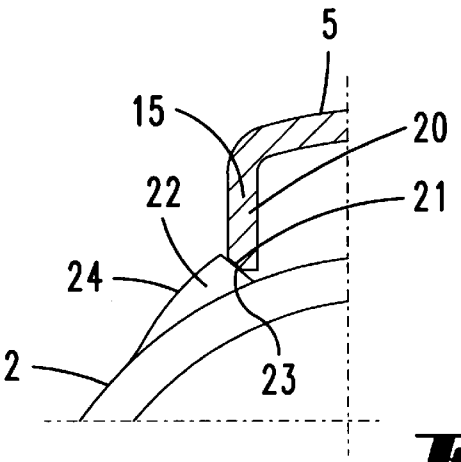
FIG. 15 shows a detail enlargement of FIG. 14, which actually embodies a modification.
Figure 14:
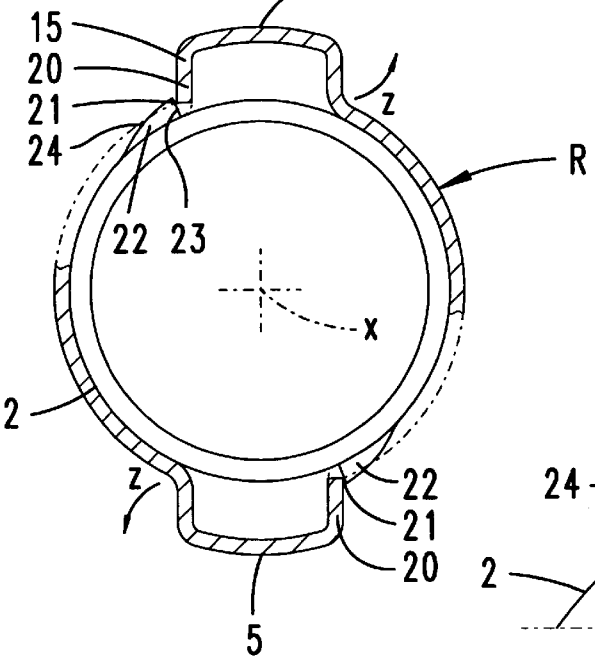
FIG. 14 shows the section according to line XIV—XIV in FIG. 13.

From FIGS. 13 to 15, a development results to the effect that in addition a, for example, self-releasing twisting-off of the closure cap 1 is furthermore also prevented. The latching arms 5 are advantageously used for this purpose, although the ring R itself could also have a corresponding precautionary means. A bent portion 20 facing away from the circumferential direction is illustrated on the latching arm 5. The bent portion lies in the direction of extent of the one leg denoted by 15. The said bent portion 20 forms a stop surface 21. The axial extension thereof or of the bent portion 20 runs as far as the top 6 of the closure cap 1.

The stop surface 21 interacts with a separate stop projection 22. It is moulded onto the bottle neck 2 of the bottle container 3. The stop surface 21 interacts with a steep flank 23 at the end of the stop projection 22 (cf. FIG. 14).

The back of the stop projection 22 decreases in a curved manner in the direction of the circumferential wall of the bottle neck 2. During putting-on of the closure cap 1, i.e. during the screwing down, the bevel 24 on the back side can be overrun using moderate forces. The correspondingly tooth-shaped stop projection 22 acts as a blocking tooth of a locking mechanism.

If the steep flank 23 of the stop projection 22 has a flank angle which is fairly steep, i.e. is directed in an imaginary line radially towards the longitudinal central axis x—x of the discharge opening 14, the closure V is irreversibly locked.

If the aim is for the space in the bottle container 3 to be accessible, for example for topping up the substance to be discharged, the closure V can be formed in reversible arrangement by the opening angle, which otherwise is at approximately 90°, being selected such that it is noticeably more obtuse. Reference should be made to FIG. 15. In this case, the flank angle of the steep flank 23 is provided in such a manner that the user is able to unscrew the thread. The corresponding ease of opening can be established at the manufacturer's by varying the flank angle. In this case, the sharpness can be taken from the stop surface 21 by its being formed parallel to the steep flank 23 (cf. FIG. 15).

Even the last-outlined rotational version of the closure is very well suited for providing the closure cap 1 of the bottle container 3 so as to spring up. This is of significance during serial initial assembly, since it saves time.

In the following, the other elements of the closure C will be briefly explained: as can be seen from FIG. 16, the top 6 is recessed in the central section. A hinged lid 25 is accommodated in the trough which is thus provided and crosses the closure cap 1. The hinged lid is equipped with a snap-in spring and has a hollow stopper 26. During a hinging movement around a lateral hinge point 27, the said hollow stopper 26 grips in a closing manner into a cavity in a discharge spout 28 which, in terms of flow, adjoins the discharge opening 14 of the bottle container 3.

A sealing collar 29, which is disposed concentrically with respect to the discharge spout 28, extends from the underside of the recessed section of the top 6. The sealing collar engages in a closing manner in the zone, which is in the vicinity of the end, of the discharge opening 14 of the bottle neck 2. An expansion taking place during this on account of the thin walls, for example, favours the gripping hold between ring R and latching projection 4.

The variant of the closure V which is illustrated in FIGS. 17 to 23 is, in principle, of an identical structure to the basic version; the reference numerals are applied by analogy, partly without textual repetitions.

Figure 16:
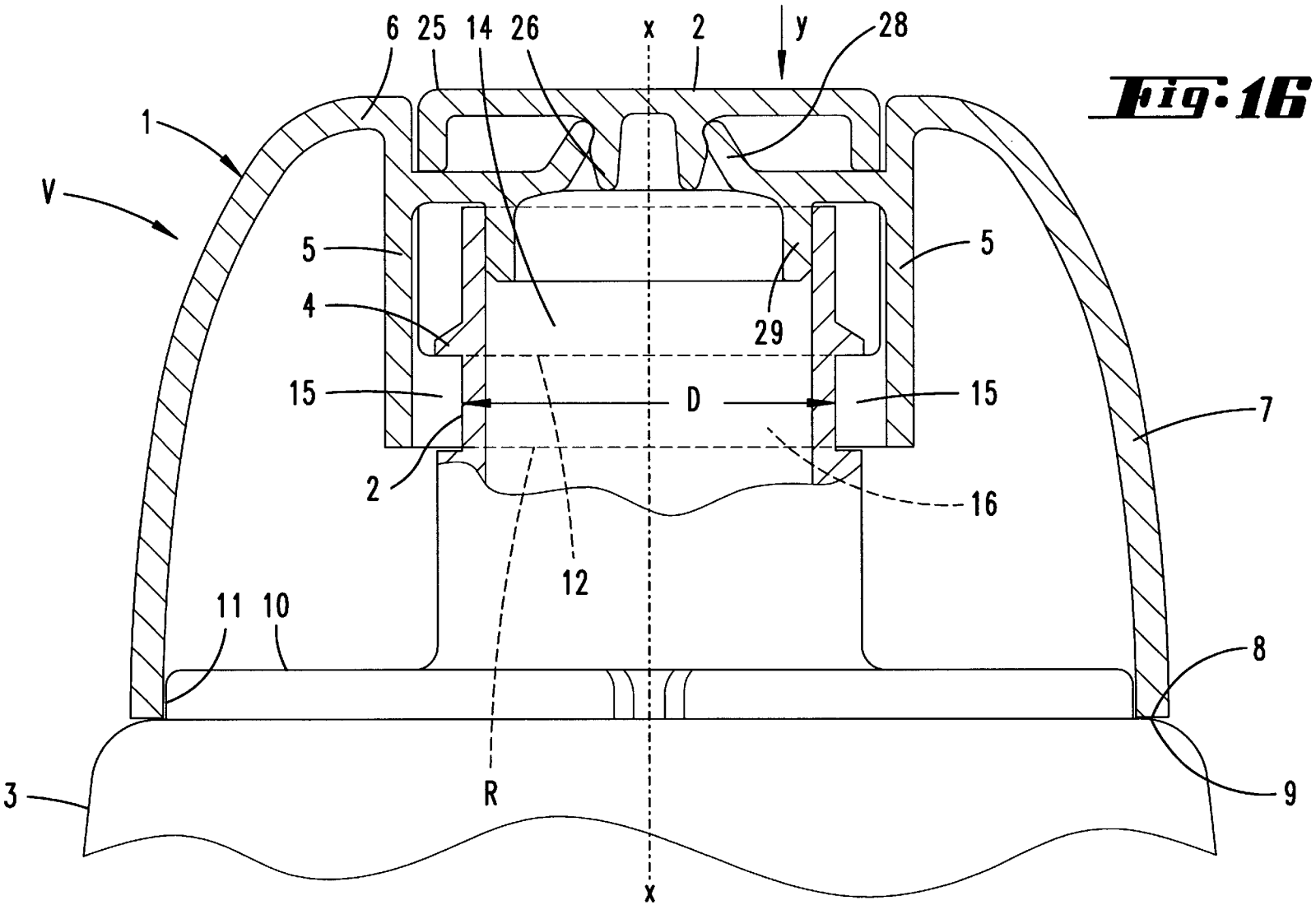
FIG. 16 shows a section through the completed dispenser, showing the basic version in terms of the ring.

One development comprises a collar 30, which corresponds to the sealing collar 29 in FIG. 16, now simultaneously taking on the function of the stop-like closure member, i.e. of the hollow stopper 26.

Irrespective of this, however, the modifying measures are also of interest for the solution form illustrated in FIG. 16.

Specifically, the procedure is such that the central collar 30 of the closure cap 1 engages, in a precentred manner in the discharge opening 14 of the bottle neck 2 of the bottle container 3.

For the purposes of the corresponding precentring, the collar 30 has a lead-in bevel S. It is situated at least on the outside of the collar 30 and clearly goes beyond the action of an outer edge chamfer of the sealing collar 29 according to FIG. 16, since the lead-in bevel S extends inwards at least by the extent of one wall thickness of the collar 30. The bevelled portion is situated at a good 45° with respect to a longitudinal central axis x—x of the closure V.

The lead-in bevel S interacts with an edge 31 of the bottle neck 2 of the discharge opening 14. There is in question an end edge whose inner rim is chamfered. The annular chamfer, which falls away obliquely inwards, is denoted by 32. It forms the neck-side guide-in part during the docking of the closure cap 1. The edge 31 is set back by one wall thickness of the neck 2 and is therefore stabilised.

The lead-in bevel S is in fact set back or curved inwards by a dimension which is a multiple of the wall thickness of the collar 30.

A lead-in bevel S formed from a plurality of separate lead-in tongues 33 is illustrated. There are in question shell-shaped projections having an approximately semi-circular contour. The four lead-in tongues 33 are disposed distributed at equal angles over the circumference of the entire lead-in bevel S. There is a ring of inwardly curved fingers. Because of their curvature which emerges clearly from FIG. 20 and is convex from the outside, there is virtually even a hemispherical head of the collar 30. This visibly feels its way without problems into the circular discharge opening 14. This even happens when not introduced linearly along the longitudinal central axis x—x, as arises in FIG. 20. Further springing-up action steers the collar 30, which lies somewhat obliquely there, into a coaxially coincident position, as can be seen from FIG. 21.

Another development comprises, in the case of a fully closed formation, the closure cap 1 having a separately mounted covering part 34 on the outside. A closed formation means that the interior of the collar 30, even in the case of the development in which it is realised as a hollow stopper, does not have any openings in the top of the closure cap 1. The collar 30 acts in a sealing manner.

The covering part 34 is formed in the manner of a spherical cap. It can serve as an information carrier for the illustrated closure V. The flat-surfaced edge periphery of the covering part 34 in the form of a spherical cap is associated with the closure cap 1 in a correspondingly flat-surfaced, falling-away region of the closure cap 1. The flat-surfaced region of the top 6 is denoted by 35. The bevelled portion is situated in the direction of the longer ellipse axis of the container, which is formed in cross section in a corresponding manner.

The covering part 34 is associated with the flat-surfaced region 35 in the manner of the latching connection. For this purpose, latching projections 36 extend from three edge portions, located spaced-apart, of the shell-shaped covering part 34. These latching projections grip under corresponding undersides of latching holes 37 in the top 6.

Figure 20:
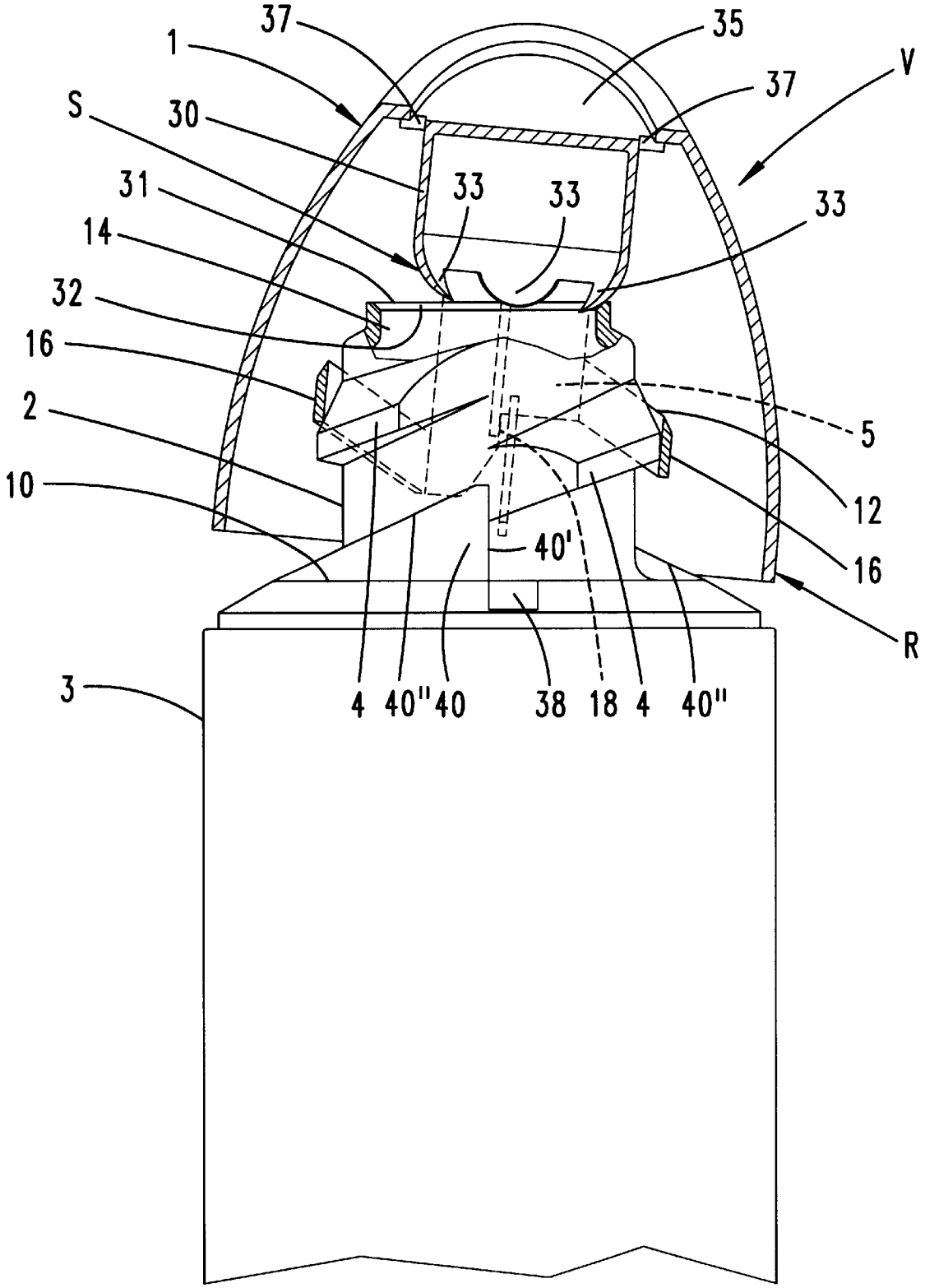
FIG. 20 shows the bottle container in a fitting phase.

As can be gathered from FIG. 20, the flat-surfaced region 35 is recessed within the contour extent of the covering part 34. The edge of the covering part is therefore neatly mounted; the latching projections 36 are relieved of load.

Figure 17:
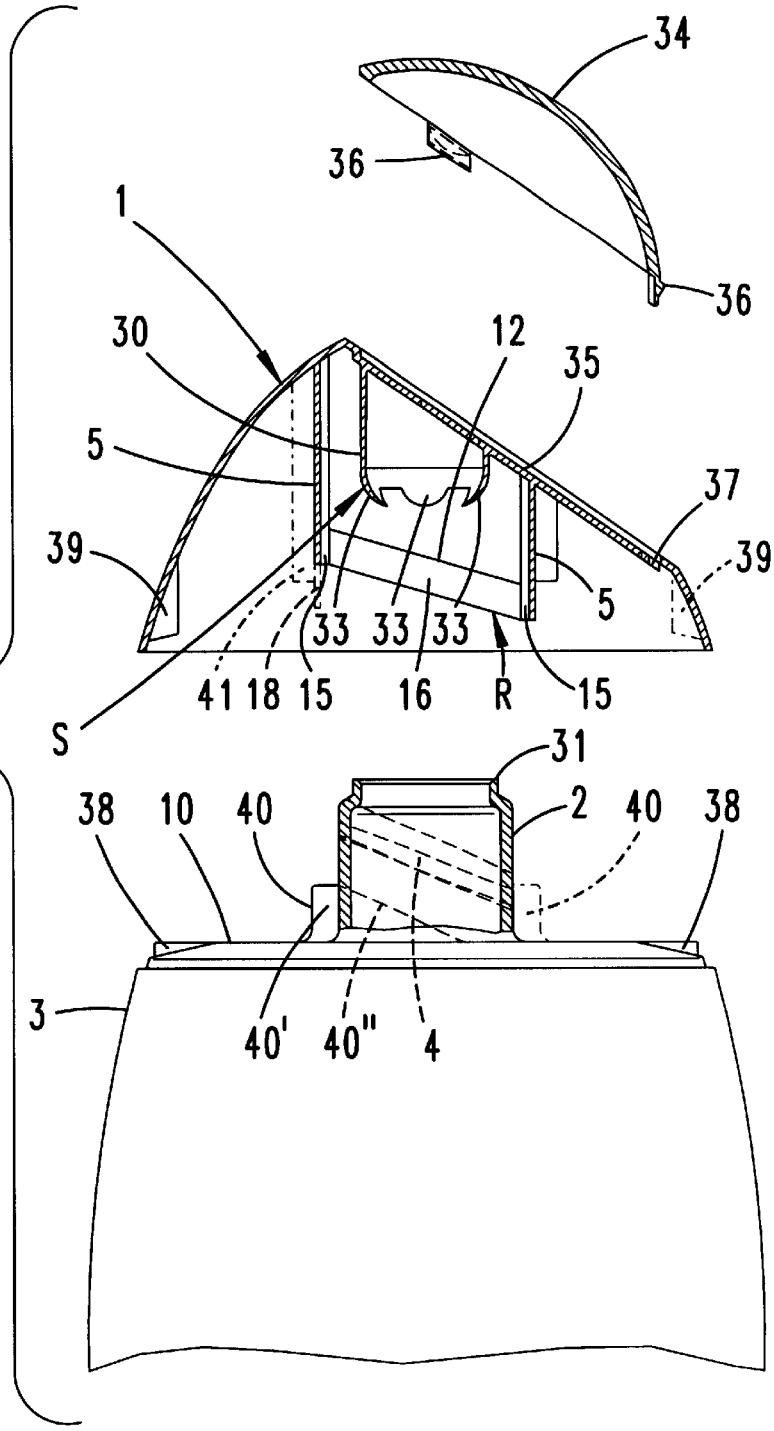
FIG. 17 shows a variant of the closure in an exploded illustration, partly in section, partly (the bottle container here) partially broken open.
Figure 19:
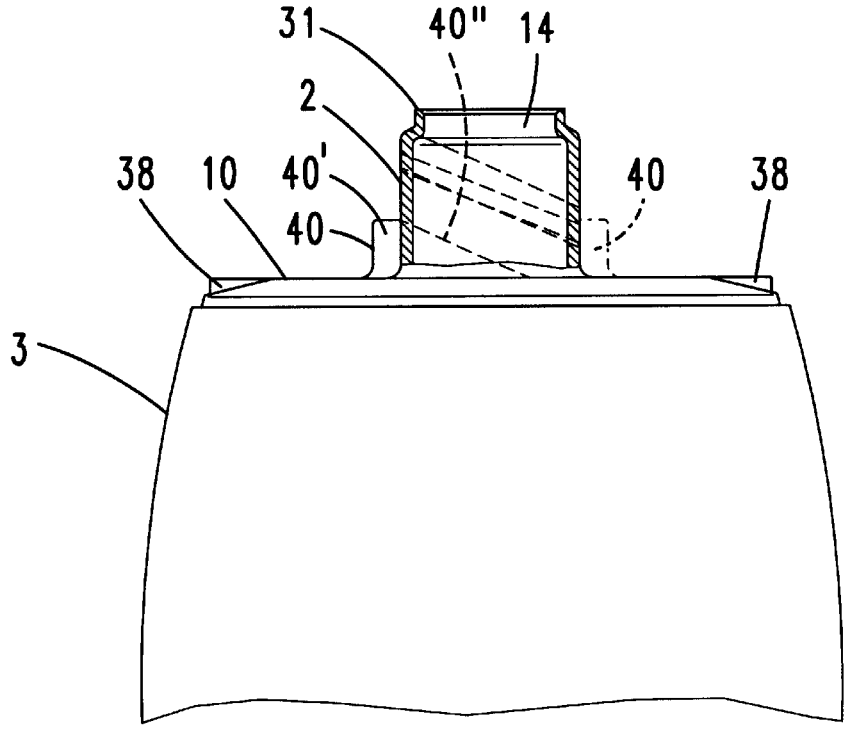
FIG. 19 shows the side view thereof with the bottle neck broken open.
Figure 18:
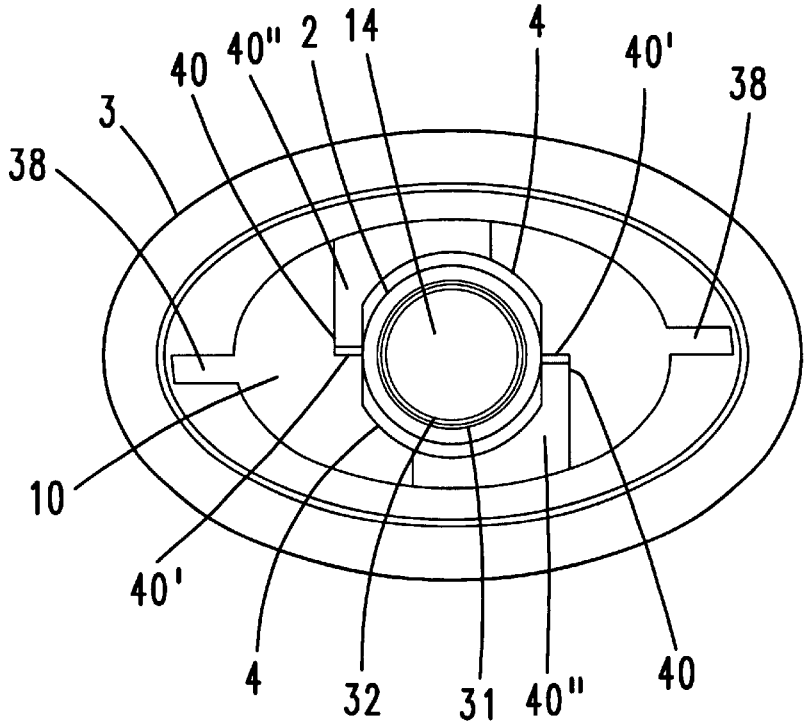
FIG. 18 shows the plan view of the bottle container.
Figure 21:
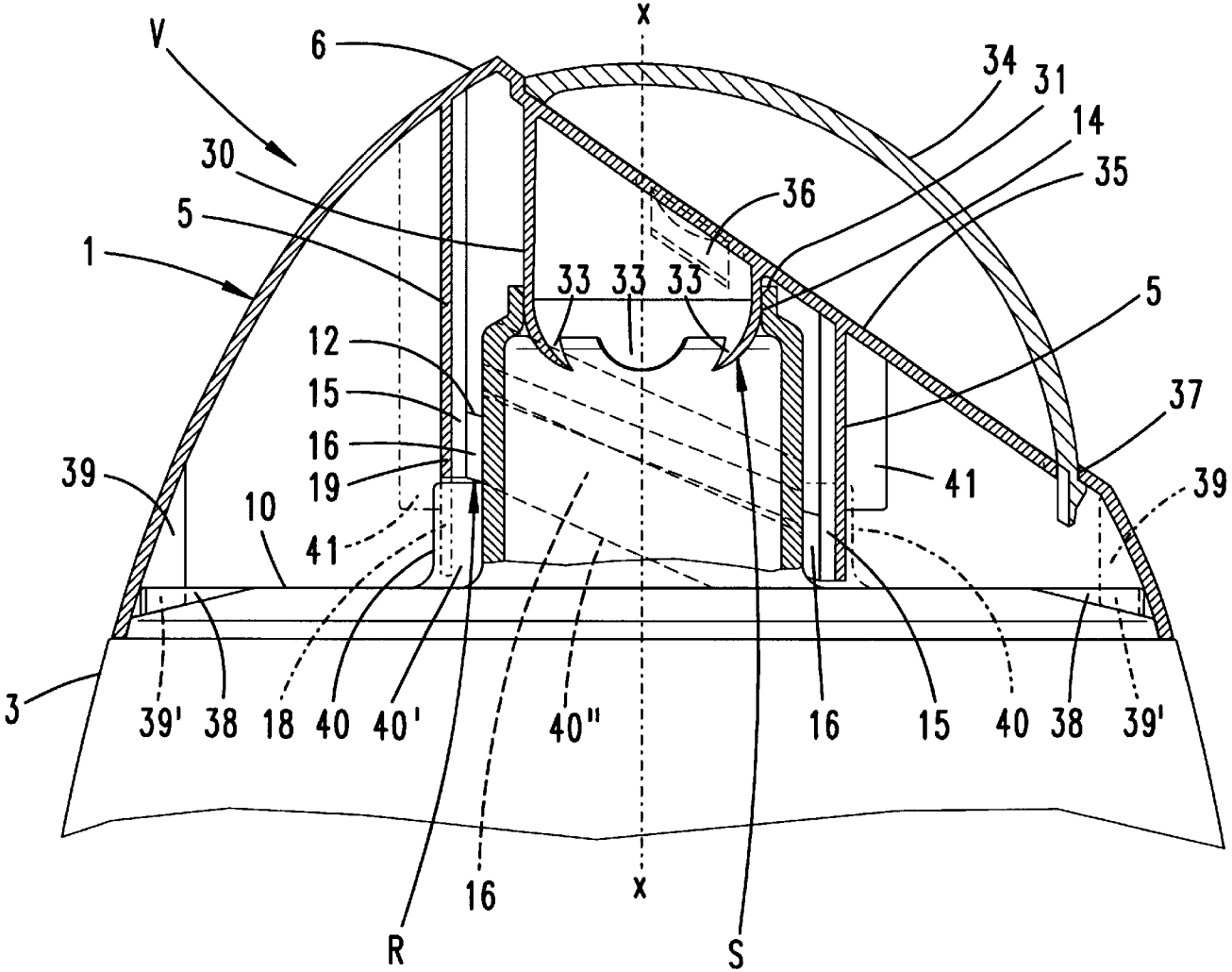
FIG. 21 shows a cross section through the closure in a completed fitted state, with a means of securing the closure cap against unscrewing brought into action.
Figure 22:
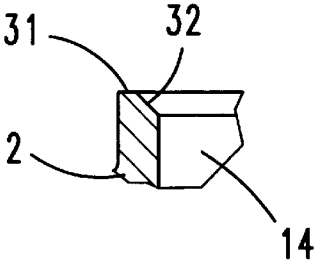
FIG. 22 shows a detail enlargement of the rim of the bottle neck.
Figure 23:
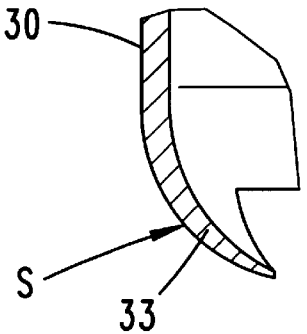
FIG. 23 shows a detail enlargement of the collar of the closure cap.
Figure 24:
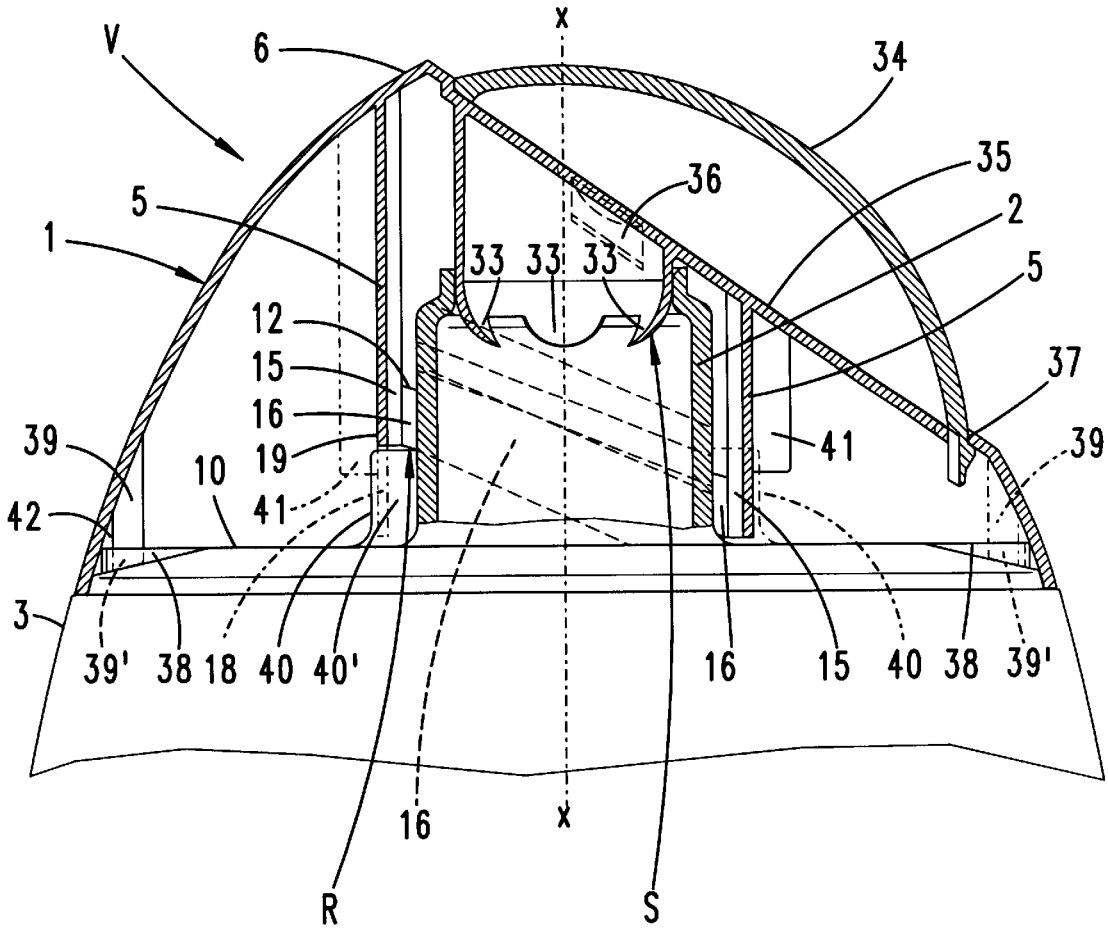
FIG. 24 shows an illustration corresponding to FIG. 21, but illustrating a development with regard to a means of securing against self-releasing unscrewing.

Also in the case of the development of FIG. 17 et seq., a rotation-limiting stop is realised for the closure cap 1, which is put on by screwing. This is achieved by the stop strip 19 now being formed directly by a stop surface 18 of the latching arm 5. Reference should be made to FIGS. 21 and 24. It can be gathered from both these illustrations that the stop strip 19 interacts with the steep flank 40', acting as a counter stop, of a neck strip 40. The neck strip 40 is seated at the base of the bottle neck 2, and is rooted both in the plateau 10 and in the annular wall of the bottle neck 2. The bottle strip 40 can easily be produced by a blow-moulding technique. Its back 40" falls from the upper edge of the steep flank 40 towards the broad sides of the bottle container, which has an elliptical cross section, and passes onto the plateau 10. A profile is present which substantially corresponds to that of the thread of the latching projections 4. That region of the back 40" of the neck strip which is in the vicinity of the circumferential wall acts at the same time as a guide for the thread.

In the screwed-down end position, the stop surface 18 of the stop strip 19 engages fully against the steep flank 40'. In this case, the stop and counterstop are disposed in such a manner that the edge zone, which is congruent with the contour, of the base of the closure cap, which is thus likewise elliptical, is positioned precisely.

Of course, the same applies in the case of the above-outlined spring-action putting on of the closure cap 1.

The screwing-down direction is in the clockwise direction.

The ring R is held in a particularly stable manner if the back of the latching arm 5 or of the stop strip 19 is stiffened by a ridge strip 41. The said ridge strips extend in the longer ellipse axis of the container. One broad side lies in the same plane as the stop surface 18. On the top side of the closure cap 1, the ends of the ridge strips 41, which are provided in pairs, are rooted in the inner wall. The ridge strip 41 gives the latching arm 5 a T-shaped cross-sectional profile with an outwardly facing T-web. Facing towards the plateau 10, the ridge strip 41 ends level with the lowermost, upper extension of the sections 16 towards the latching arm 5. The end there is located deeper than the highest elevation of the neck strip 40. There is therefore a partial overlapping. The paired nature, also realised here, of the means permits an optional putting-on in separate angular ranges of roughly 180°. Since the threads are removed diametrically opposite one another, the angular range of rotation for the unscrewing releasing lies even more clearly below it, specifically at about 110°.

The development according to FIG. 17 et seq. furthermore also shows means for securing against self-releasing unscrewing of the closure cap 1, specifically on the basis of a reversible, audibly perceptible latching between closure cap 1 and bottle container 3. In this case, the hollow form of the closure cap 1, which hollow form forms, as it were, a sound element, is effective in promoting audibility.

In specific terms, the constructional means comprise the closure cap 1 having, on the inside, a spring-elastic edge wing 39. The edge wing interacts with fixed edge ribs 38 of the bottle container 3 with the screw-on end position being reached. The centrally orientated edge ribs 38 are gripped from behind in a latching manner. In the clockwise direction, the edge ribs are overrun by the edge wings 39. Restoring force and play are such that the steep flank, which can be gripped from behind, of the edge ribs 38 is reliably reached. The unscrewing again of the cap of the closure cap 1, for example for refilling the bottle container 3, takes place intentionally with the application of an additional force apart from the normal rotational force. The latching force is sufficiently strong that customary mechanical loads on the closure cap 1 do not lead to the gripping from behind 38/39 being released.

The means for securing against self-releasing unscrewing of the closure cap 1 is formed as a pair.

As is illustrated, the edge wings 39 are rooted in the form of vertical strips in portions of the inner wall of the closure cap 1 which are in the vicinity of the edge. The narrow sides of the edge wings 39 are not connected over the entire vertical length to the inner wall; rather, according to the variant of FIGS. 24/26, there remains a non-connected, free resilient region of the edge wing 39 forming a particularly springy tongue 39'. The edge rib 38 which does not leave the corresponding clearance 42, is, with regard to the tongue, also denoted by 39' (FIG. 21). The clearance 42, which faces downwards, i.e. towards the plateau 10, emerges particularly clearly from FIG. 24. Of course, the free resilient tongue 39' does not need to reach as far as the peripheral bevelled zone of the plateau 10. It suffices if a gap remains with respect to the plateau, which gap assists the movability of the tongue 39'.

With regard to FIG. 25, another development of the type of closure arising from FIG. 5 will now be explained. The latching projection 4 there is an annular flange running therefore perpendicularly with respect to the longitudinal central axis x—x. Reference has already been made to the suitability of the described docking system for preform bottle containers. Since the blank for bottle containers 3 of this type is produced by injection moulding, the latching projection 4, which can be referred to as a snap-in bead, has very stable and non-flexible characteristics. The upper flank of the latching projection 4 lies horizontally, i.e. it does not have a conventionally used, falling-away flank angle. Therefore, a deflection acting in a centring manner for the ring R cannot be obtained from this. In order, nevertheless, in this regard to ensure the interference-free springing-up of the closure cap 1, it is proposed for that section 16 of the ring R which grips under the latching projection 4 in a hooking manner after putting-on of the closure cap is completed, to be arranged obliquely with respect to the longitudinal central axis x—x. The latching of the closure cap 1 is therefore possible with the least effort. In addition, because of this special form of the latching band or ring R, the horizontal rear hooking force component directed towards the center is increased. This makes an overall improvement in the retaining ability and the firm fit of the closure on the bottle container 3.

Figure 25:
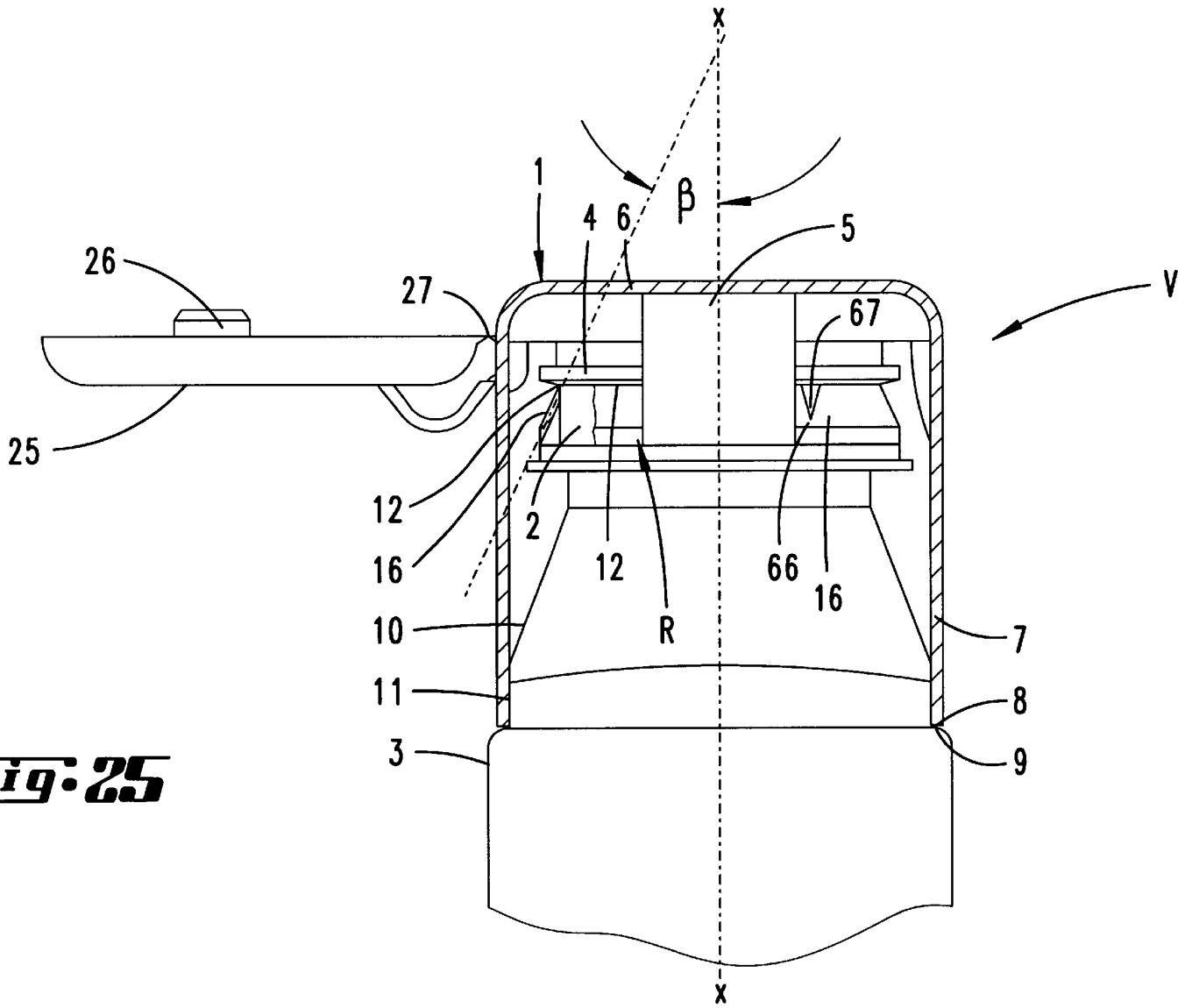
FIG. 25 shows a sectional illustration corresponding to FIG. 5, embodying a development of the ring.
Figure 26:
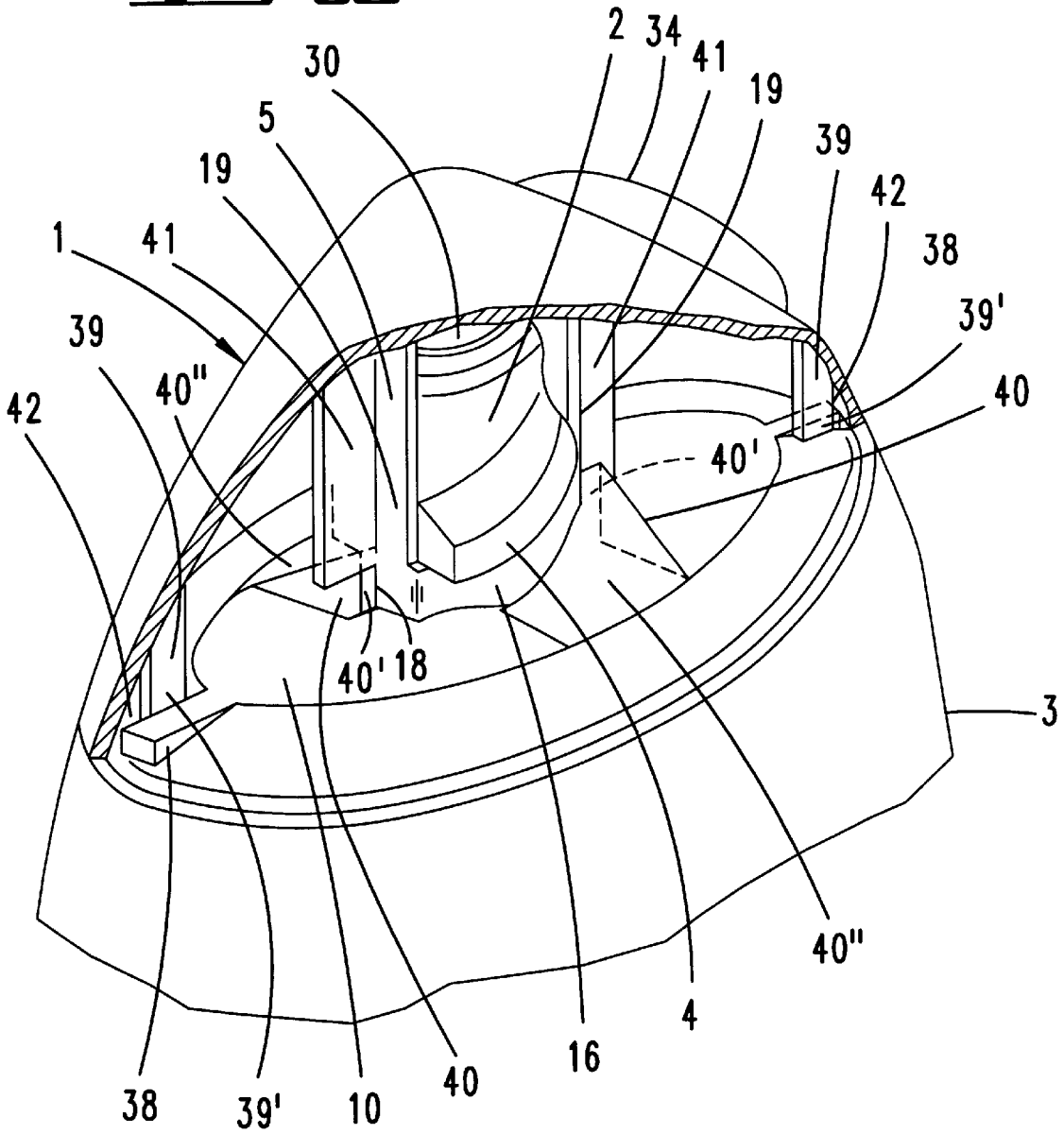
FIG. 26 shows FIG. 24 in perspective illustration with the closure cap partially broken open.
Figure 27:
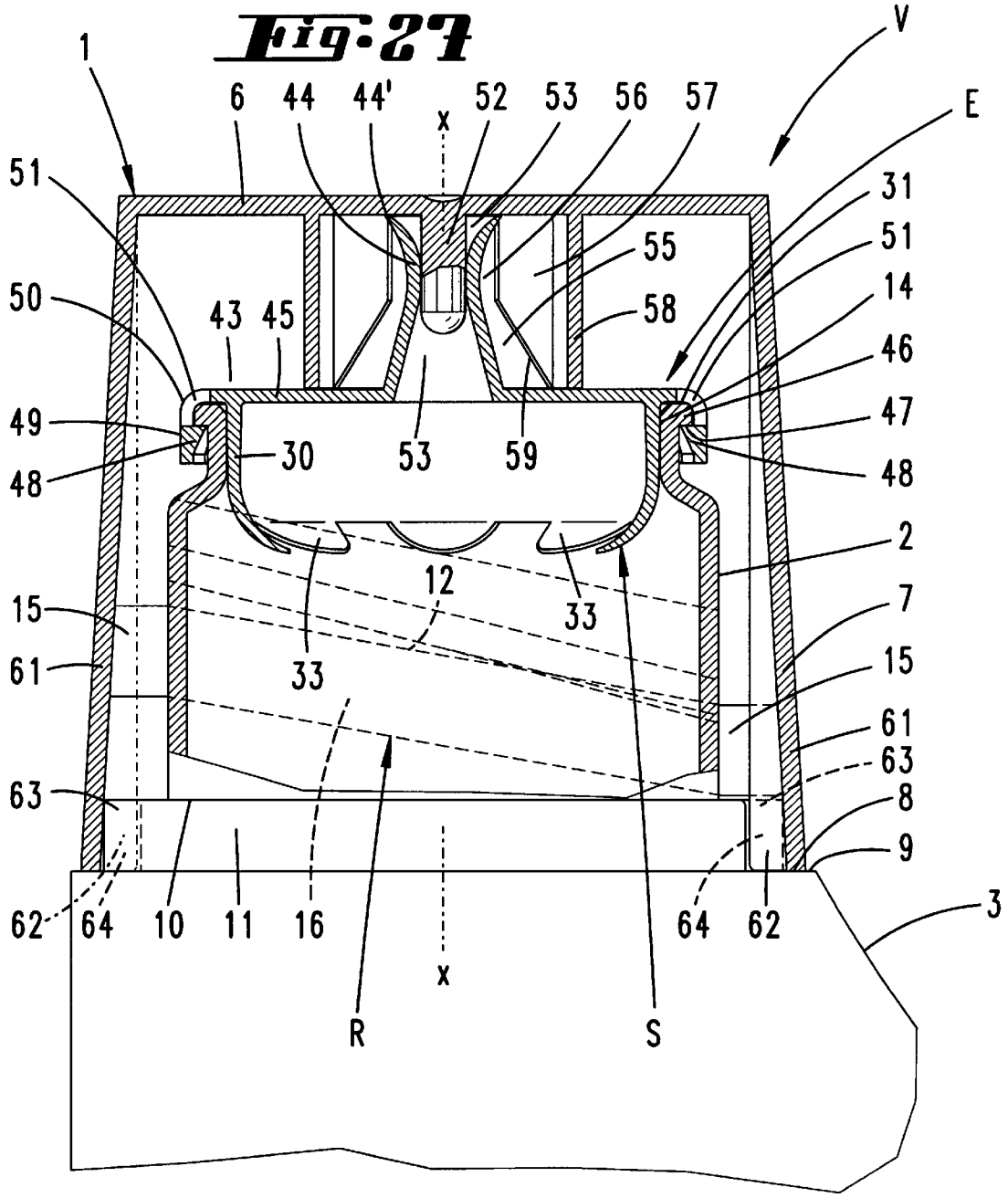
FIG. 27 shows a further variant of the closure cap together with a bottle container, a spray insert being associated with the closure, all details being shown in vertical section or in partial vertical section.
Figure 28:
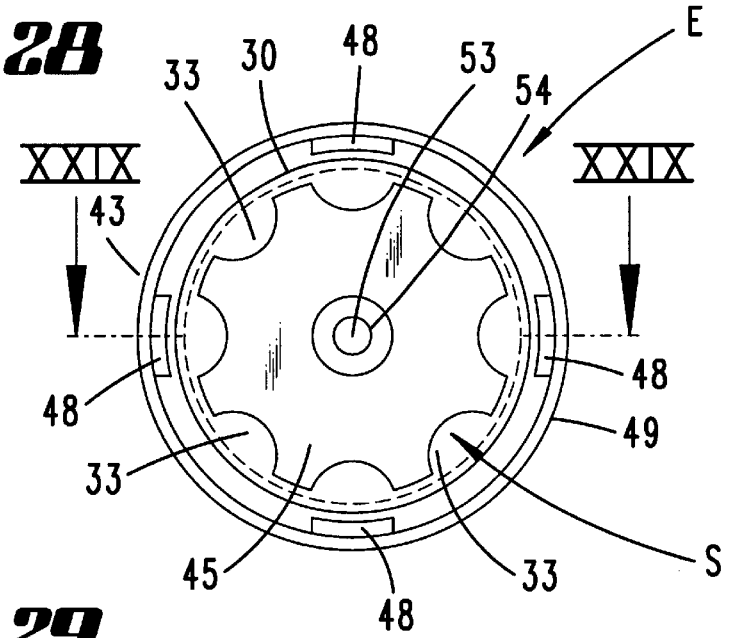
FIG. 28 shows the spray insert formed as an intermediate cap, in a view from below.
Figure 29:
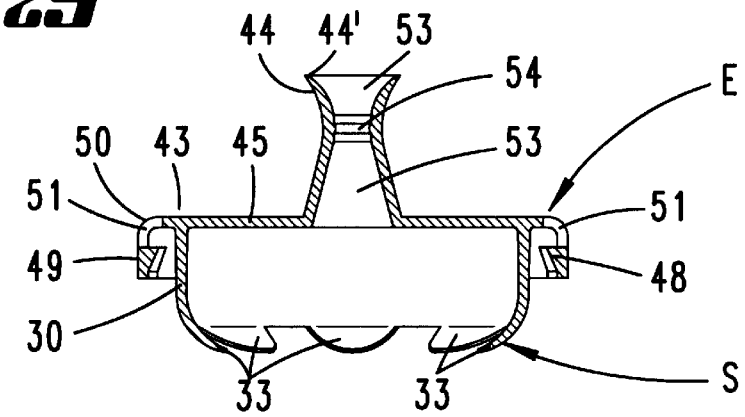
FIG. 29 shows the section according to line XXIX—XXIX in FIG. 28.

The angle used is at a good 20° and is denoted in FIG. 25 by beta. Of course, the corresponding oblique position needs to be limited only to the length regions of the ring R, which are exposed to the hooking action of the latching projection 4.

As can be seen, the section 16 or the sections 16 has/have a rhomboidal cross section. The parallel narrow-edge extent of the sections 16 is therefore such that the undergripping projection 12 tapers out in the vicinity of the bottle neck. The end facing away from the undergripping projection 12 tapers out outside the edge of the latching projection 4. This also cannot result in a putting-on of the lower end in the manner of a cutting edge, since the funnel formed at least by the sections 16 or its container-side edge is larger than the external diameter of the latching projection 4.

Turning now to the development, illustrated in FIGS. 27 to 37, of the dispenser or container with the closure V. This variant of the closure V is, in principle, of identical structure to the above-explained forms; the reference numerals are applied by analogy, partly without textual repetitions.

This variant now provides means which make it possible for the relatively large, clear cross section of the discharge opening 14 of the bottle container 3, which is favourable for filling, to be changed to a reduced cross-section in order to be able to produce a spray jet rather than a pouring jet. For this purpose, a spray insert, denoted in its entirety by E, is associated with the discharge opening 14. There is in question an intermediate cap 43 having a spray hole which is of small cross section.

In order to form a powerful, directionally stable spray jet, the intermediate cap 43 has a centrally situated spray spout 44. The spray spout is moulded directly onto the top 45 of the intermediate cap 43 and protrudes projecting upwards, widening out on the end.

The intermediate cap 43 is latched to the bottle neck 2 in a manner grasping over its edge. The latching means is located on the outside of the bottle neck 2.

From the edge 31 of the bottle neck 2, there extends a latching bead 46 which is directed outwards therefrom. Its lower-side flank 47 is gripped under by latching lugs 48. The flank of the latching lugs which is active in the latching extends at the same level as the said lower-side flank 47, which extends perpendicularly with respect to the central axis x—x of the relatively large discharge opening 14 of the bottle neck 3.

A total of four latching lugs 48 distributed at equal angular spacings is realised. These are located on the inside of the intermediate-cap edge 49. The cap edge 49 is realised as a narrow annular wall which, running concentrically with respect to the edge 31, merges, via a transversely convex rounded portion 50, into the top 45 of the intermediate cap 43.

Looking vertically, the latching lugs 48 substantially occupy the lower half of the annular wall of the intermediate-cap edge 49. The back of the latching lugs 48 is bevelled, specifically in the manner of the typical lug back, with the result that the overrunning of the latching bead 46 is achieved with moderate to low forces.

To assist in the radial spring-out capability of the latching lugs 48, the latter are cut free in the manner of windows in the back, i.e. above the region of the horizontal flank. The window is denoted by 51. It extends partially into the annular wall of the intermediate-cap edge 49 and, in a broad dimension of the bead 46, correspondingly also runs into the region of the top 45, specifically to a hook width lying in the circumferential direction. In addition to the explained spring capability, there is also an advantage in terms of production: transverse displacement of mould cores is not needed.

The intermediate cap 43 has a collar 30 which corresponds, with regard to the sealing, to the variant of FIG. 17 et seq. It is formed as an annular wall which extends from the underside of the cover 45 and tapers in towards the free end, rounding inwards as it were in the manner of a spherical cap. A head structure of this type has the same centring action as is described in detail with regard to FIG. 17 et seq. This collar 30, which is inserted in the discharge opening 14 in a sealing fit, merges therefore on the bottle-container side into a lead-in bevel S, also formed here by individual lead-in tongues 33. The other details apply to the extent explained above and are not to be repeated here.

With the closure cap 1 placed on, the spray spout 44 is closed. To this end, there serves a stopper 52 protruding vertically on the inside from the top 6 of the closure cap. The stopper is formed as a hemisphere at the end and over its remaining upright length has a cylindrical circumferential wall. The rounded end zone of the stopper 52 and the upwardly widening-out spout cavity 53 assist in finding the insertion location to give a final, sealing engagement. In the region of a waist-like constriction, there is an encircling sealing bead 54. From this, the spout cavity 53 again widens in the direction of the bottle neck 2.

In addition to this inner form, which is effective in a centring manner, there is also an outer centring effect between the closure cap 1 and the spray insert E, more precisely the spray spout 44. Specifically, this results in the provision of a centring funnel 55 which merges halfway along it into a spray-spout centring shaft 56.

The spray-spout centring shaft 56 and its preceding centring funnel 55 is formed by thin-walled radial strips 57. The latter extend from the inside of the top 6 and are rooted therein. The funnel-and shaft-forming silhouette is provided by the inside narrow edges of the radial strips 57. A total of six radial strips 57 disposed at equal angular spacings are provided.

As can be gathered from the drawing, the radial strips 57 are connected to one another in the region of their outwardly facing narrow edges, i.e. by an annular wall 58 in their back. This substantially cylindrical annular wall is likewise rooted in the underside of the top 6 of the closure cap 1.

In the closed position of the container, the lower end wall of the annular wall 58 ends shortly before the upper side of the top 45 of the spray insert E or engages against it.

The circular, level opening lip 44' of the spray spout 44 is already guided in early on in a centring manner via the lead-in bevel 59, which converges towards the top, of the centring funnel 55, and is supported peripherally against the non-bevelled sections of the centring shaft 56.

Figure 7:
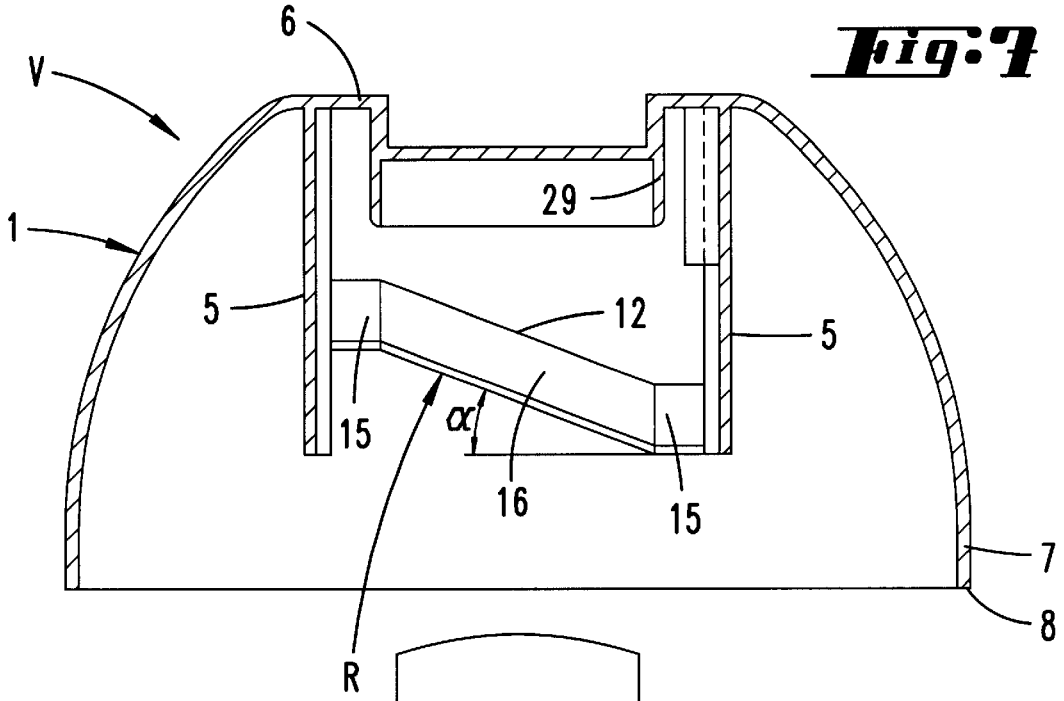
FIG. 7 shows the section according to line VII—VII in FIG. 6.

With regard to the form of the ring R, which is also formed here in the closure cap 1, it remains to be recorded that the legs 15 of the section 16 are rooted in the wall of the closure cap 1, on the inside thereof. The relevant, wall-side transition points of the legs 15, which run in parallel, carry the references numeral 60. The form emerges particularly clearly from FIGS. 31 and 33. This ring R is identical to the one illustrated in. FIGS. 1 and 7, but in this case, the ring-closing bridge between the two legs 15 is no longer produced by a latching arm 5, but by that wall portion 61 of the cap wall which lies in between. Since the cap wall is thin-walled, the aimed-for spring capability or constricting-restoring capability is nevertheless present. The reference numerals are also transferred here.

As can be seen from the further variant, there is also a development concerned with the aspect of the child-proof lock. This is embodied by blocking cams 62 being formed which protrude on the inside of the cap in the vicinity of the wall edge of the closure cap 1 and run longitudinally. The blocking cams extend over the annular-bridge wall portion 61. They interact with mating cams 63 which are located at the base of the bottle neck 2 and run in the axial direction. The back of the mating cams can be overrun in the rotation-closing direction of the closure cap 1. In the screwing end position, the blocking part of the blocking cams 62 is located in a blocking manner in front of the radially orientated steep flank 64 of the mating cam 63. By radially inwardly directed pressure on the circumferential wall of the closure cap 1 in the section plane XXXII—XXXII (FIG. 31), the blocking cams 62 can be freely released. In the process, the circumferential wall passes into an oval edge structure which, once it is released, restores itself.

Figure 30:
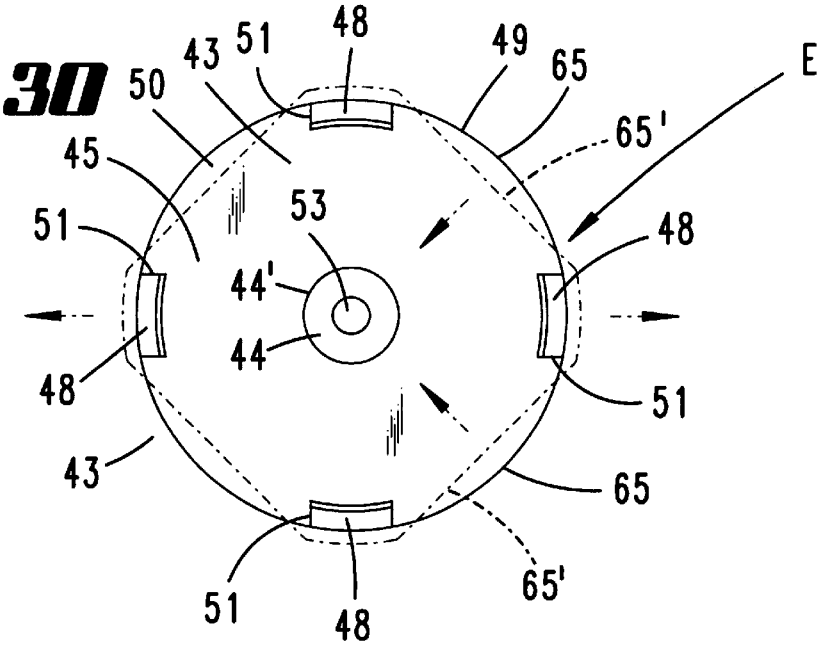
FIG. 30 shows the intermediate cap in plan view.
Figure 31:
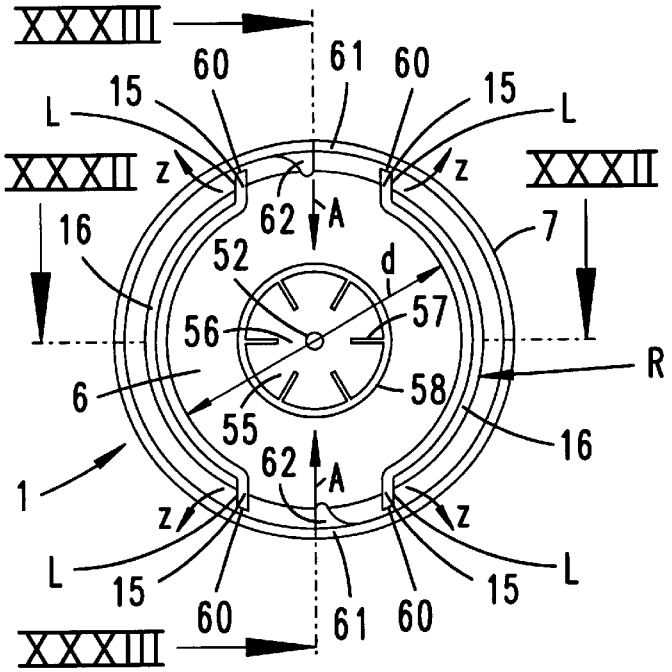
FIG. 31 shows the closure cap in a view from below.
Figure 32:
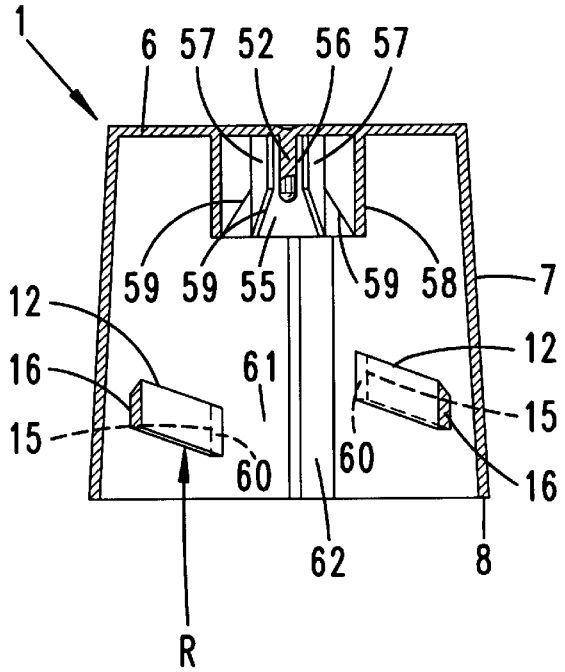
FIG. 32 shows the section according to line XXXII—XXXII in FIG. 31.
Figure 33:
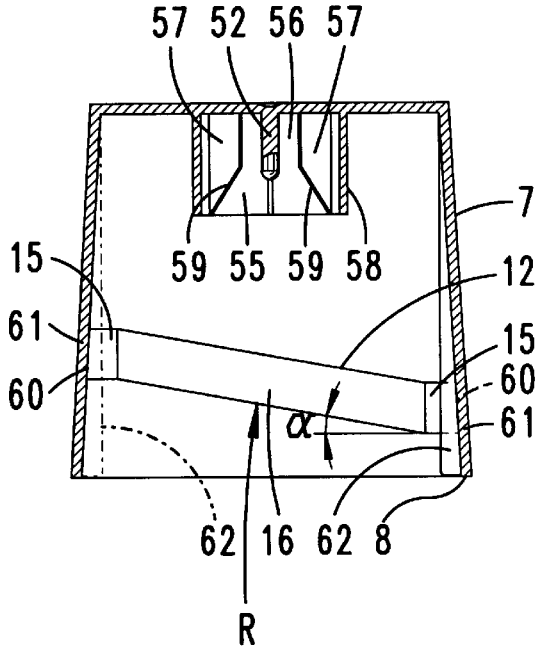
FIG. 33 shows the section according to line XXXIII—XXXIII in FIG. 31.
Figure 34:
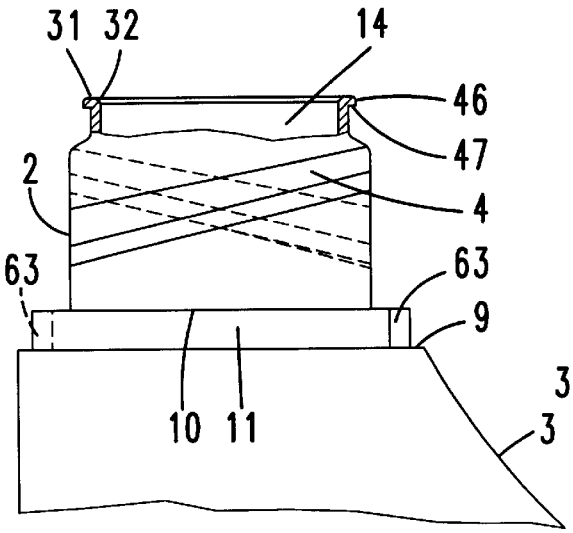
FIG. 34 shows the head region of the bottle container in side view with the bottle neck broken open.
Figure 35:
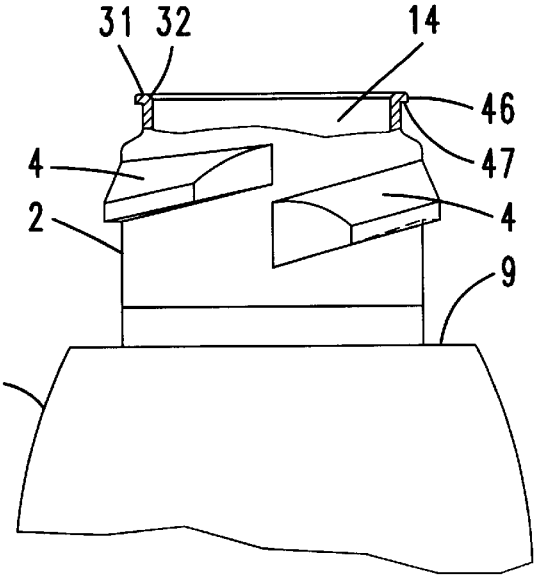
FIG. 35 shows a side view like FIG. 34, which view is rotated through 90° and is likewise broken open in the vicinity of the rim.
Figure 36:
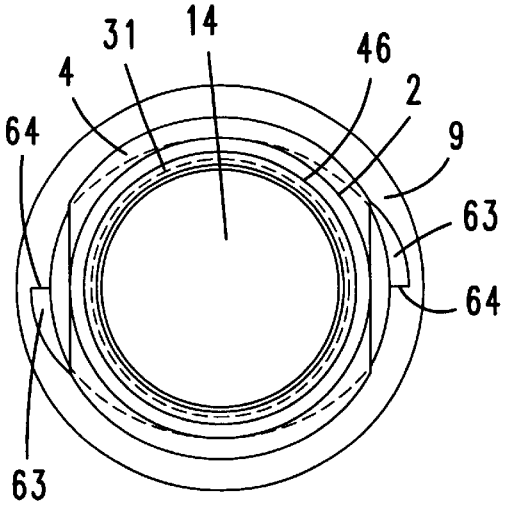
FIG. 36 shows the plan view of FIG. 34.
Figure 37:
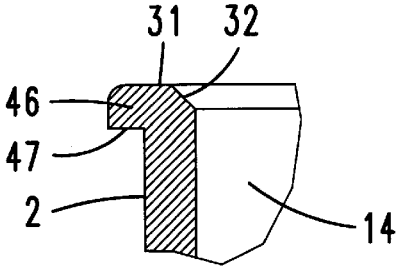
FIG. 37 shows a detail enlargement of the rim of the bottle neck.

With regard to the illustration of FIG. 30, it remains to be mentioned that with the springing-up of the spray insert E on the bottle neck 2, the four latching lugs 48 deflect radially outwards (cf. the dash-dotted position). In the process, the curved sections 65, lying between them, of the annular wall of the intermediate-cap edge 49 pass into the linear or secant-like alignment 65', which is illustrated with dash-dotted lines. This radially opposed annular-wall offset is used as a restoring-force store, so that the latching lugs 48, after passing over the latching bead 46, are pulled firmly back into the undergripping latching position (cf. FIG. 27).

The bottle container 3 is realised as a squeezable bottle.

Figure 4:
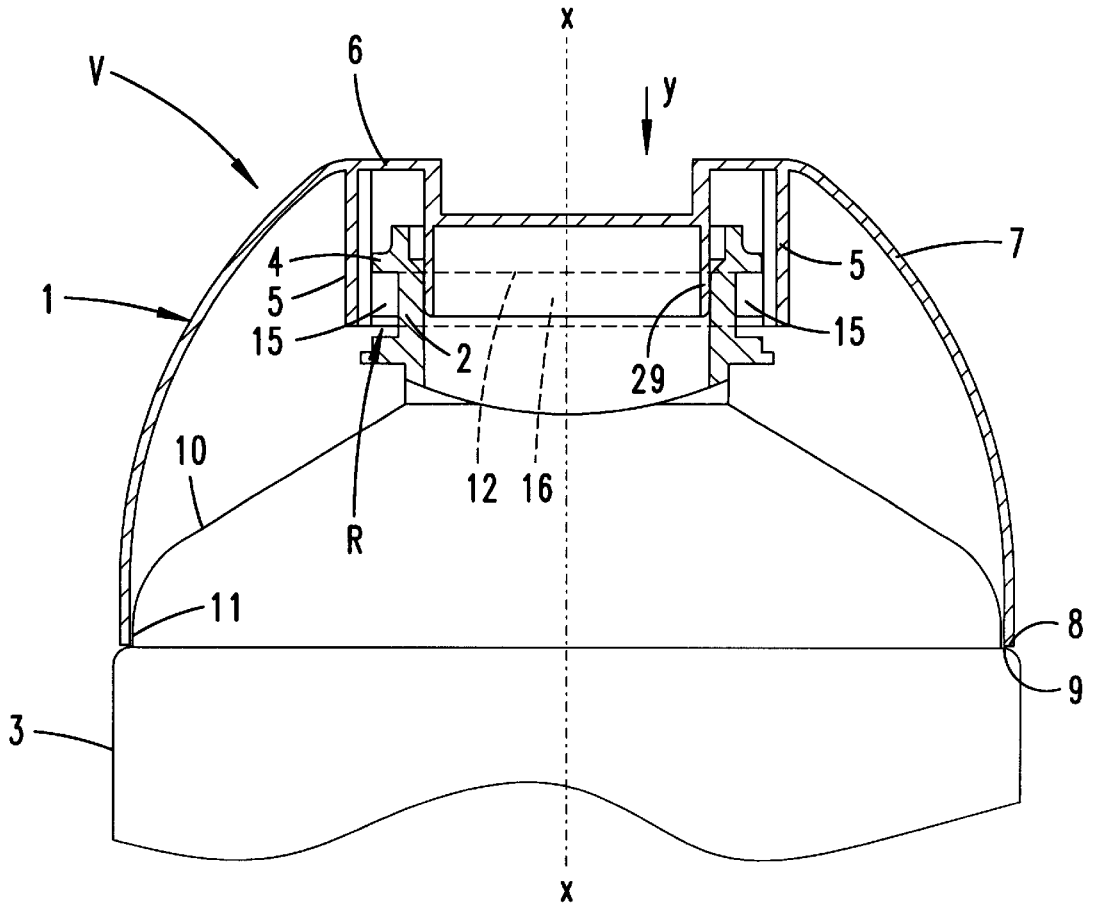
FIG. 4 shows the section according to line IV—IV in FIG. 3.
Figure 38:
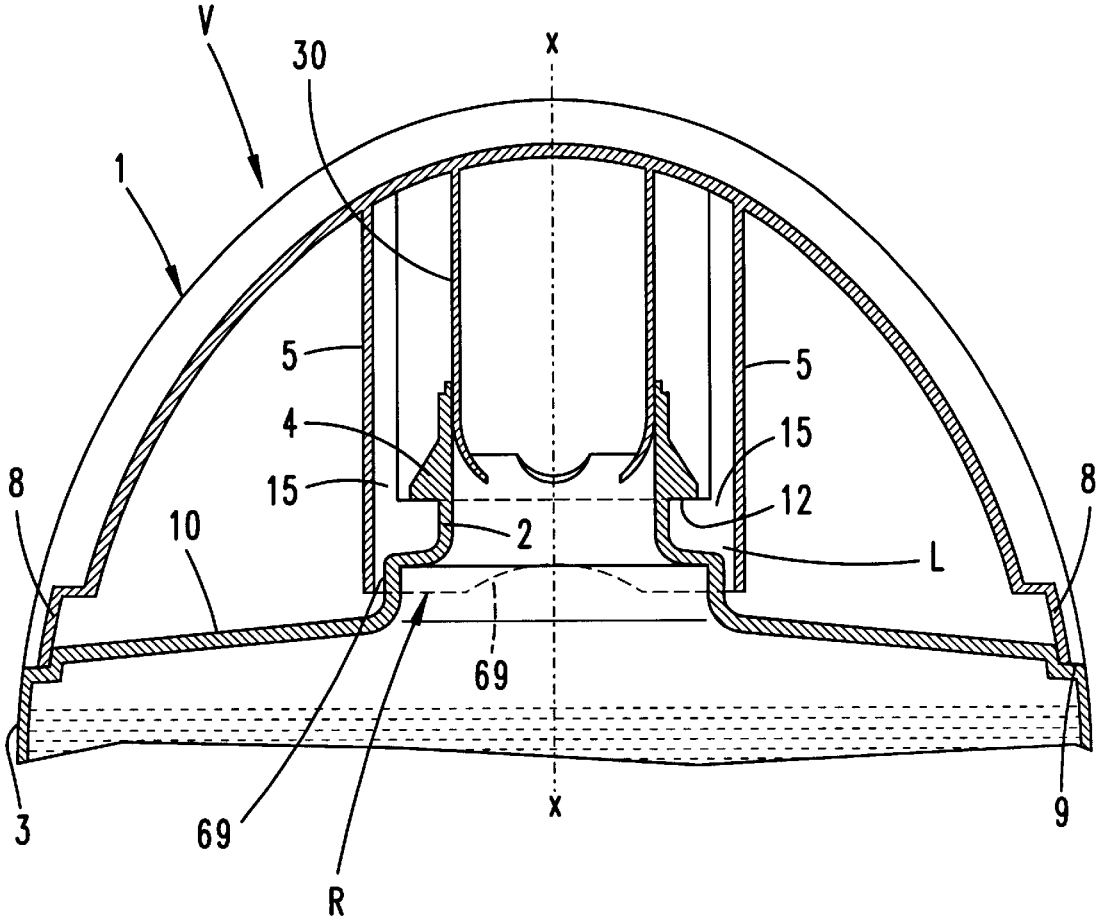
FIG. 38 shows a development of the closure, based in terms of the ring on the basic version.
Figure 39:
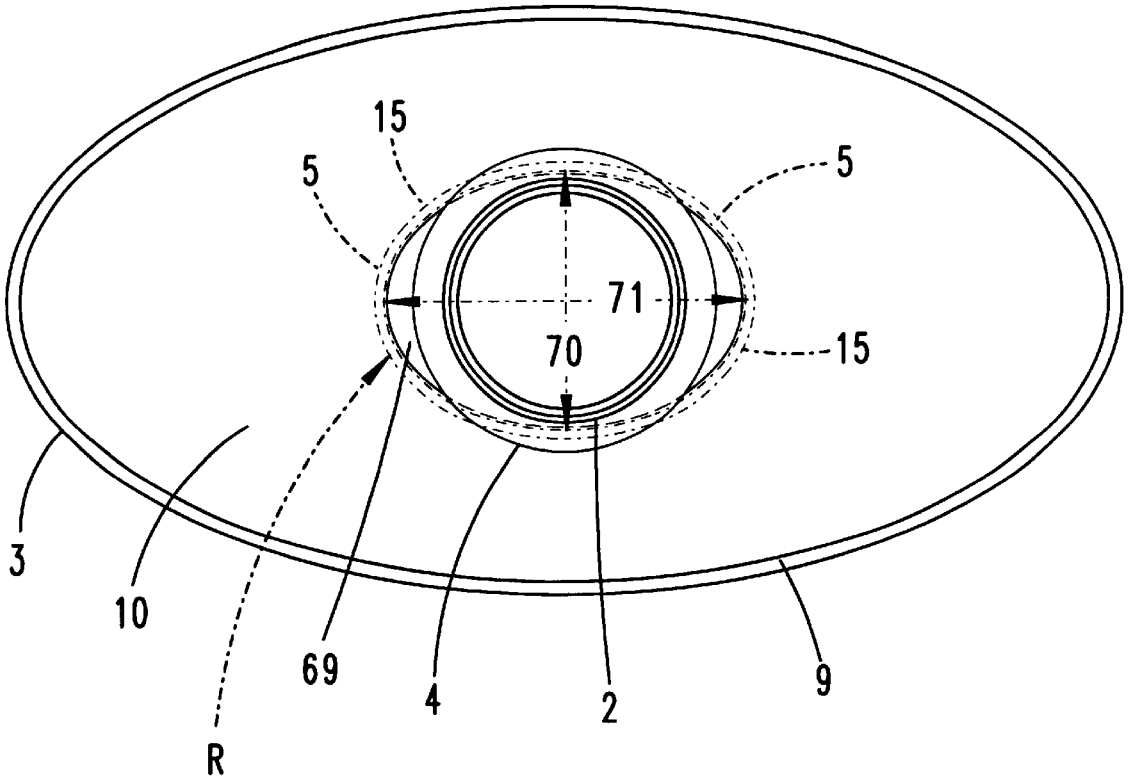
FIG. 39 shows the plan view of the bottle container with the closure cap indicated only with dash-dotted lines, but only showing the ring here, specifically in the closure position.
Figure 40:
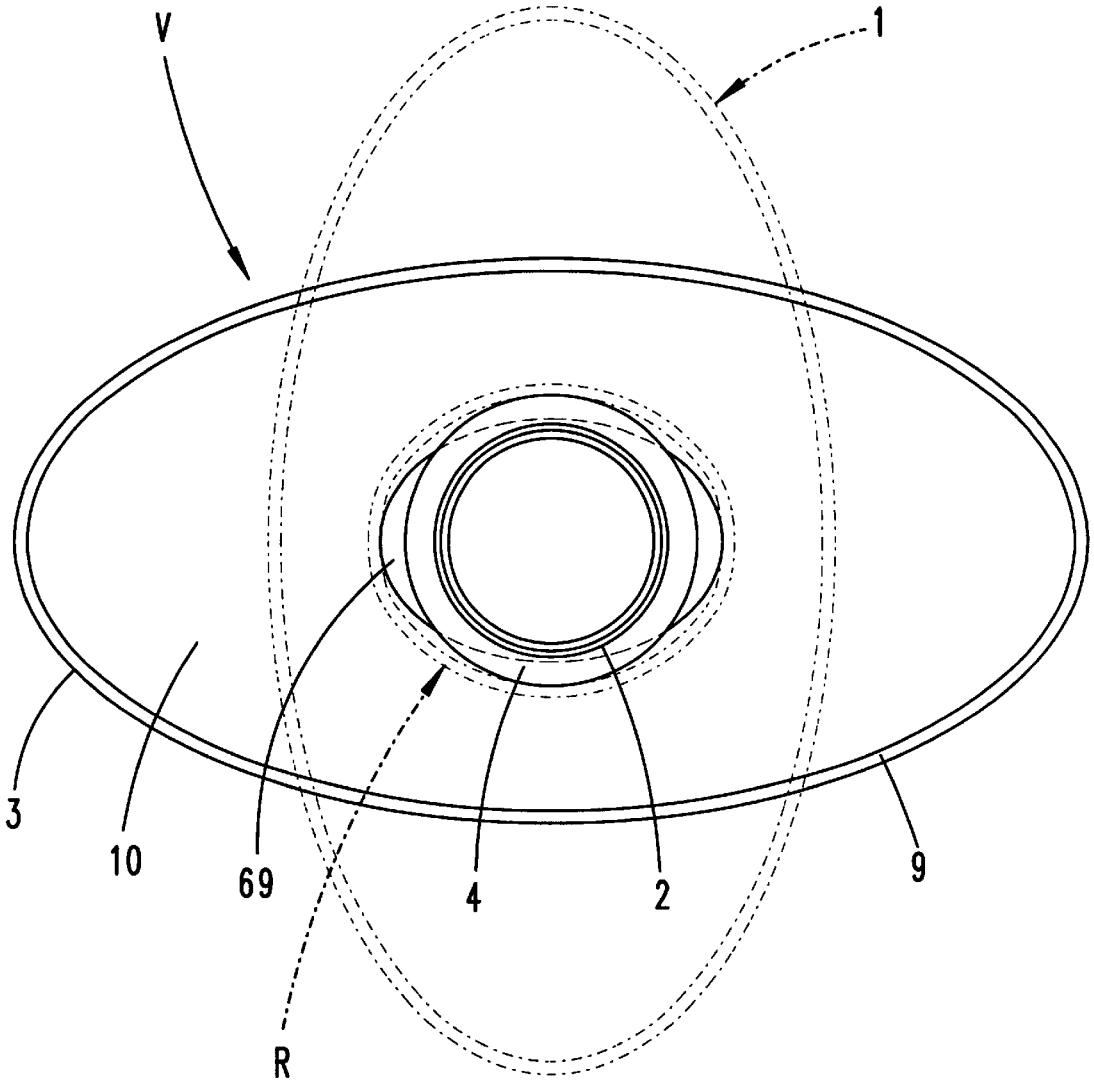
FIG. 40 shows an identical plan view as in FIG. 39, in a transverse position of the closure cap, which position releases the ring, again with dash-dotted lines.

The subject-matter according to FIGS. 38 to 40 shows the basic provision of a closure V according to FIG. 4 or 25, in which the bottle neck 2 of the preform bottle container 3 has a continuously encircling latching projection 4 which, although it can be overrun there by the ring R for the purpose of plug-in fitting, can then only be passed over again in the opposite direction by destroying the ring R. This generally takes place by tearing off the ring R at at least one latching arm 5. In this manner, there is an indication of originality. However, the constricting force of the ring R is sufficiently large that the container can be used further, i.e. the closure cap can snap open. Remaining with this basic version, it should furthermore be explained that the ring R has a predetermined breaking point. This is denoted in FIG. 25 by 66. It can be realised as a V-shaped incision extending from the upper-side undergripping projection 12, which is also pointed here, of the ring R. This incision 67 makes the ring R more flexible in terms of expansion, which facilitates the irreversible plug-in putting-in-place aimed for and at the same time protects the predetermined breaking point 66. In addition to the length store R, which can be obtained in the circumferential direction, of the band or of the sections 16, there also occurs a certain extension capability with a widening-out expansion when running over the latching projection 4. This is also assisted by the angle used, beta, which is explained with respect to FIG. 25, of the ring R and of the band forming it.

On the other hand, the hooking effect is sufficiently strong that under some circumstances even just one section 16 is needed, whether it is now formed as a half ring with ends connected to the latching arms 15 or as a full ring; in each case, the under-side bevelled flank of the latching projection 4, in conjunction with the constricting effect of the ring R, even produces a lasting tightening of the closure V against the bottle container 3. This gives a self-readjusting seal. In addition, the corresponding ability to fit closely as a consequence of the oblique positioning and the restoring force of the ring R produces a particularly tolerant-friendly spring effect.

The ring R, as illustrated in FIG. 38, can then have flat bow-like recesses 69 in some sections. These are open towards the plateau 10. Recesses 69 of this type, which are brought about spaced apart from the latching arms 5, facilitate both the spring effect and the willingness of the ring R to adjust.

Turning now to the development according to the variant of FIGS. 38 to 40. This comprises its being possible, despite the powerful latching of the ring R under the lower flank, which is horizontal here, of the latching projection 4, for the closure cap 1 to be removed from the preform bottle container 3 without any damage. This takes place in a simple manner by rotating the closure cap 1. The closure cap 1, which has, in the vicinity of the base, an oval, or rather elliptical, contour in cross section, is simply, as can be seen from FIG. 40, pivoted transversely with respect to the corresponding contour form of the bottle container. This takes place about the longitudinal central axis x—x of the container.

In constructional terms, the procedure is such that the horizontally aligned ring R interacts with a control step 69 having an oval contour. The step is formed at the base of the bottle neck 2, i.e. is moulded directly onto it. There is in question an extension protruding over the plateau 10. The extension protrudes into the interior of the ring R. Following the legs 15, the ring R also has an oval form or ellipse form corresponding to the contour. Reference should be made.to FIG. 39. The longer axes of the two ovals lie in the longer oval axis of the bottle container 3. The interaction of the control-step 69/ring R parts is such that during rotation of the closure cap 1 with respect to the latching projection 4, a narrow, clear section 70 of the ring R is expanded to a size exceeding the diameter of the latching projection. The ring R, after the corresponding clearing, and therefore also the closure cap 1, can thus easily be pulled off axially, since that section 71 of the ring R which is larger in diameter, i.e. is the further section, is tapered sufficiently far in this position for there to be no overlapping, i.e. no blocking effect, with the latching projection 4. The corresponding pull-off position, reached by a rotational angle of 90°, can be readily seen and understood from FIG. 40. As the closure V is being twisted off, the small oval axis of the closure latching band or of the ring R is expanded by the large oval axis of the bottle contour. The recesses 68 even act in an ejecting manner on the ring R, since the upper edge of the control step 69 runs as far as the level of the recess base.

Other reference numerals are inserted to assist with comprehension, although repetition of the text passages is omitted here.

Figure 41:
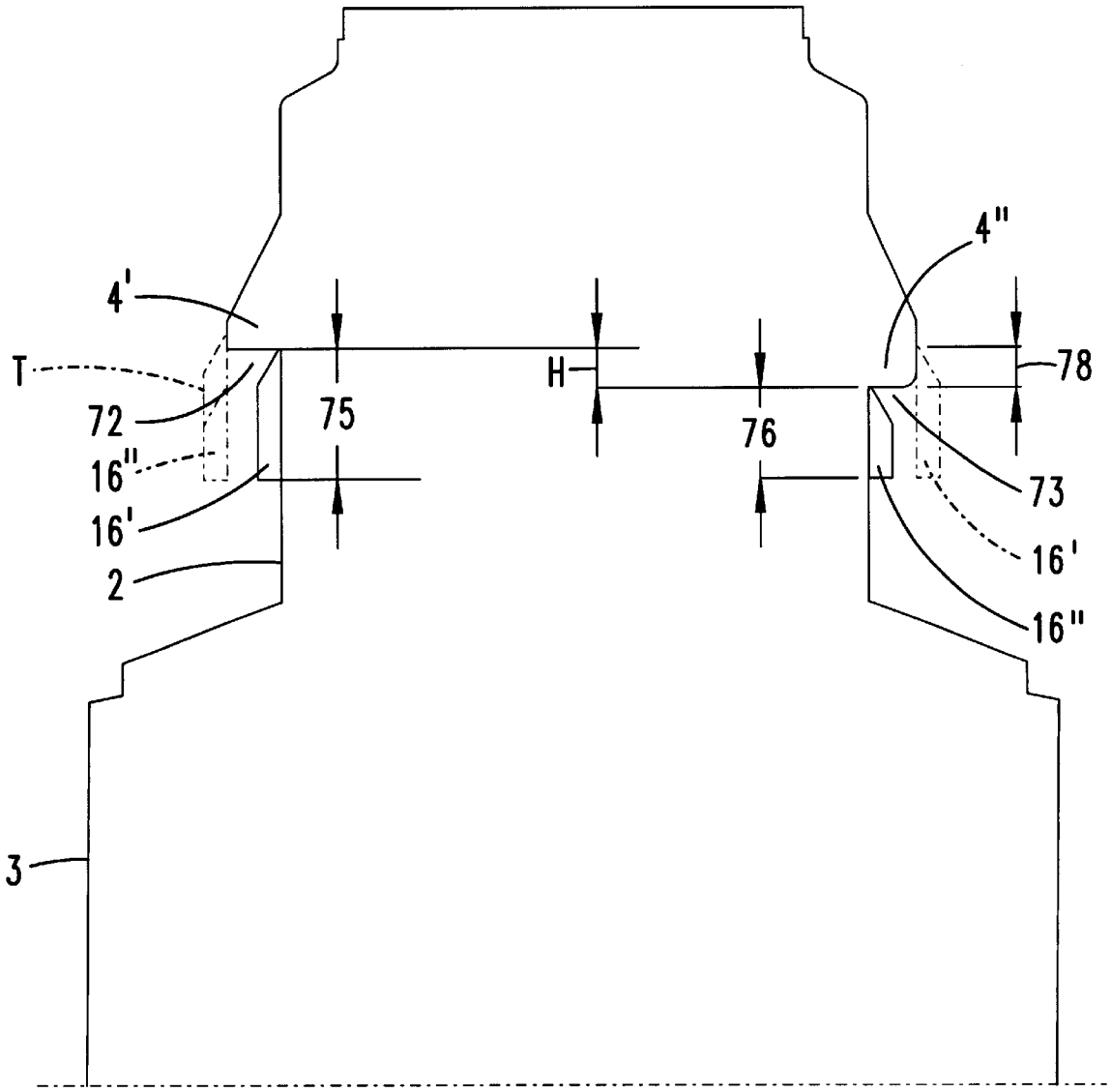
FIG. 41 shows a schematic diagram of a coding variant of the unscrewable closure.

From FIG. 41 et seq. the measures developing the screwing version will now be referred to in detail: the main difference from the above-described solutions resides in the formation of a coding. This is intended to ensure that a quite defined pairing of closure and container is achieved. To this end, the procedure is such that the ring R is formed with different sections 16', 16" each extending over half the circumference and having a fitting or blocking-but counterpart on the container. The sections are shown in the movement study of FIGS. 48, 50, 51, 53 by hatching.

Such a measure is useful in the case of asymmetrical container shapes, in which it is therefore necessary to continue the formation shapes in a visually non-disturbing manner between the two basic components of the vessel, namely closure and container. In constructional terms, this is specifically embodied by, in the closure position, a section 16' of the ring 16 lying in an undergripping space 72 with respect to a first latching projection 4' of the bottle neck 2, whereas when a closure cap 1 is turned through 180°, the same section 16' engages against the ridge of a second latching projection 4" formed opposite the undergripping space 72 of the first latching projection 4", without being prevented from being pulled off upwards, i.e. away from the bottle container 3. This emerges particularly clearly from FIG. 41. As can furthermore be gathered from this, the second, or other section 16" of the ring R is put in an undergripping space 73 with respect to the second latching projection 4" on the bottle neck 2. When a closure cap 1 is turned through 180°, a width-enlarged part T of the circumferential length of this second section 16" engages against the ridge of the first latching projection 4', without being prevented from being pulled off.

The second latching projection 4" visibly runs with respect to the first latching projection over part of its circumferential length as a threaded section; in contrast, over a further part of its circumferential length, it is formed with a horizontal collar 74.

The circumferential lengths each extend over a quarter circle of the ring R. The first latching projection 4' extends over its circumferential length, corresponding to half a circle, in the manner of a screw thread.

Figure 42:
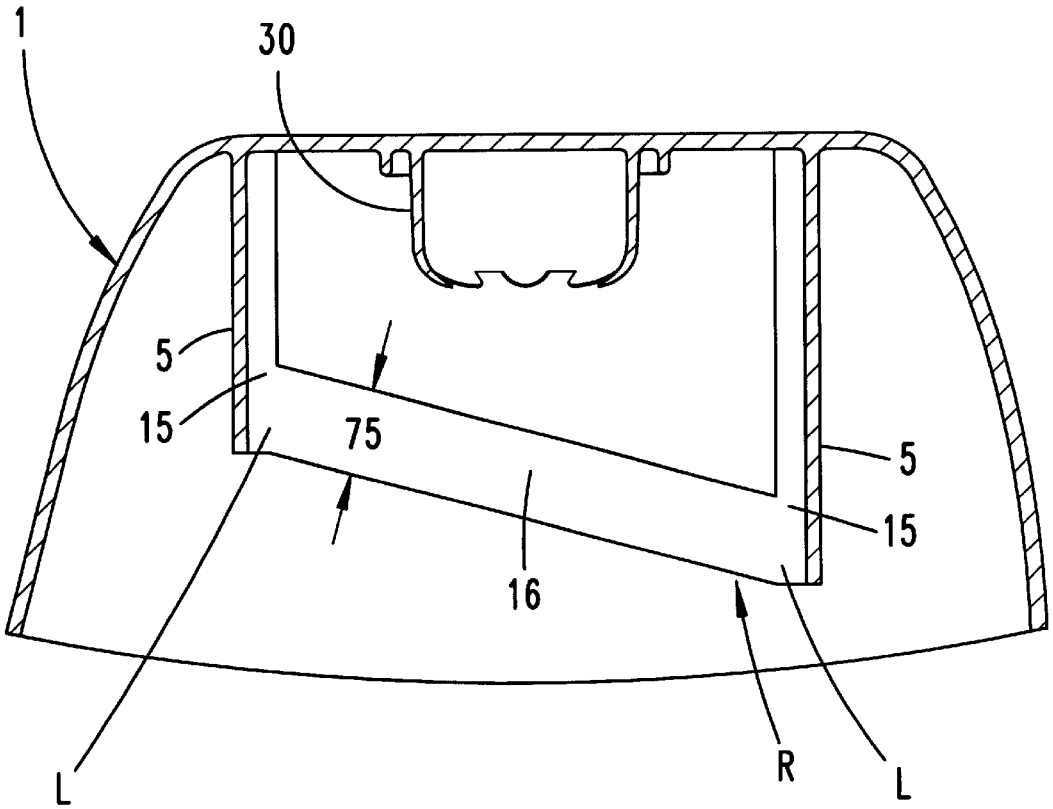
FIG. 42 shows the closure cap in this regard in vertical section, showing the one section of the ring.
Figure 43:
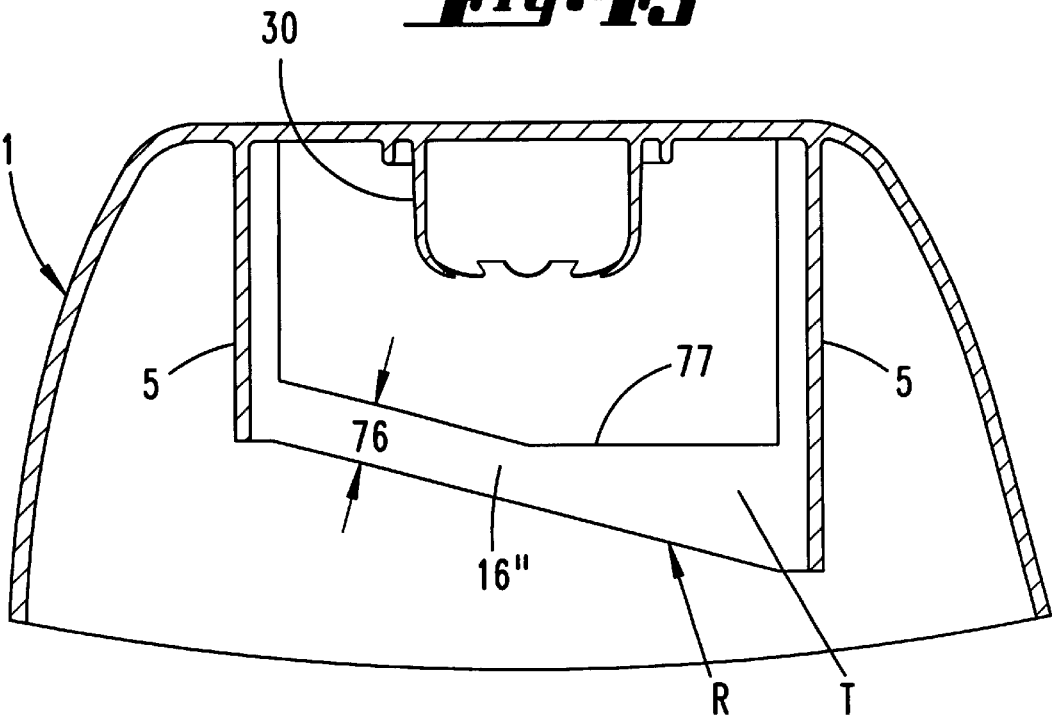
FIG. 43 shows an identical section, representing the other section of the ring.
Figure 44:
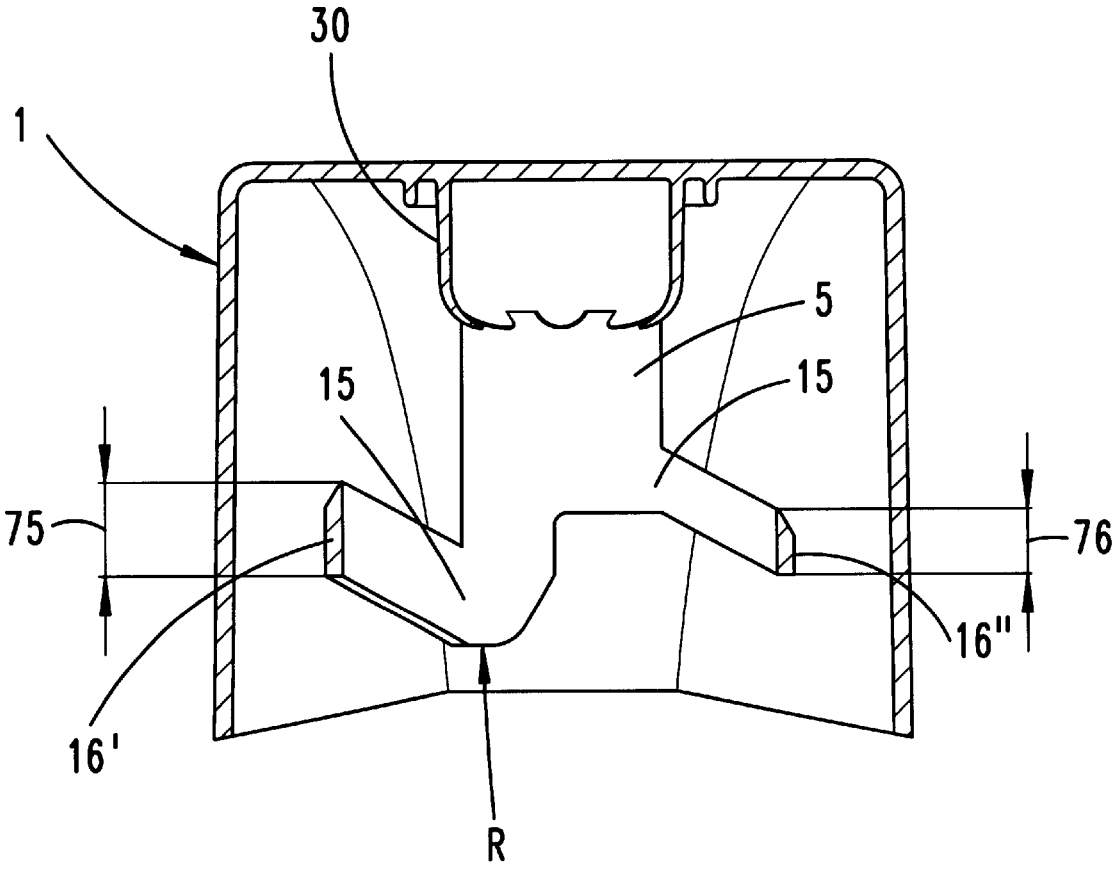
FIG. 44 shows a cross section of the closure cap.
Figure 45:
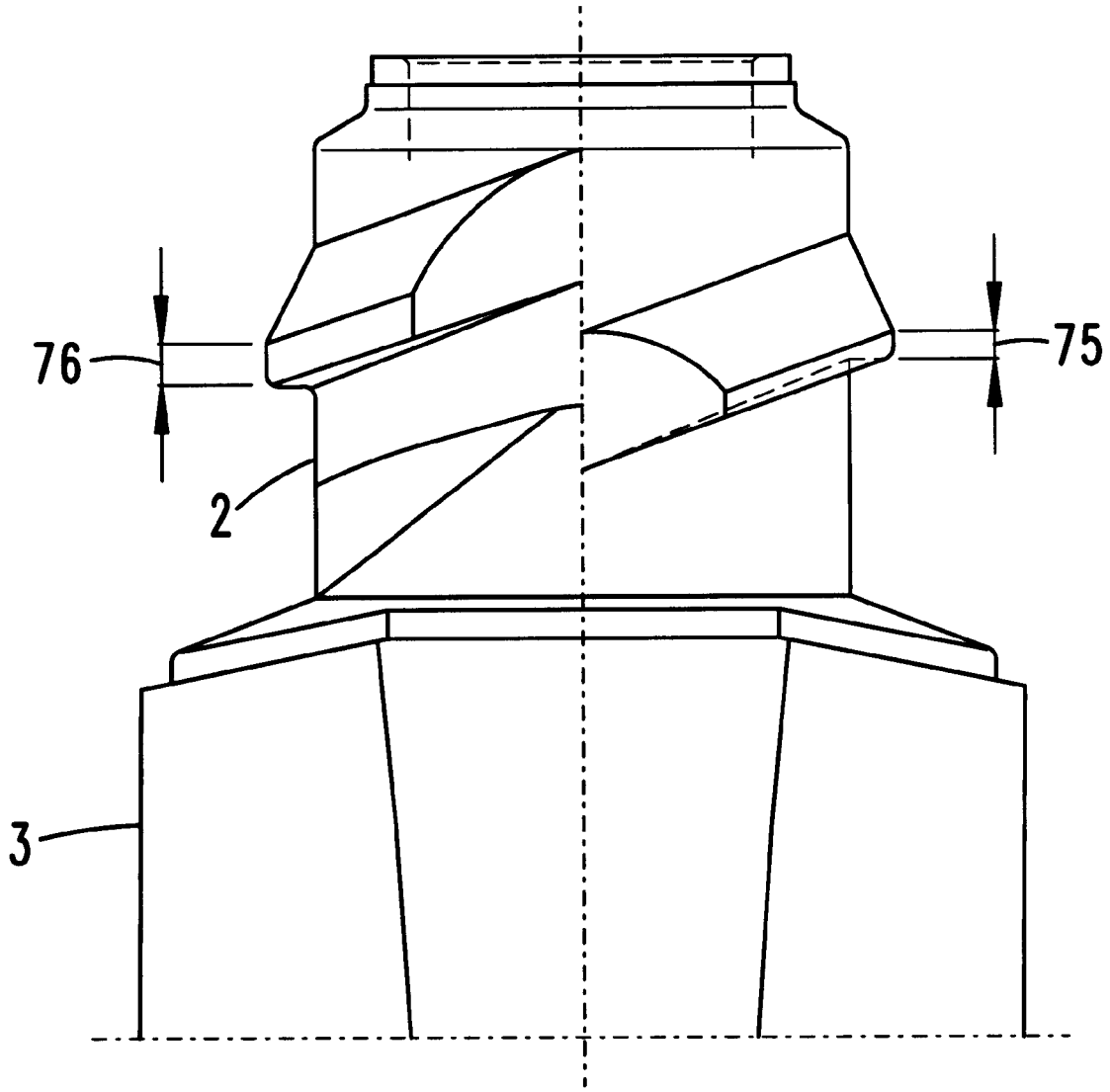
FIG. 45 shows the relevant bottle container showing latching projections in the form of threads, looking towards the one end.
Figure 46:
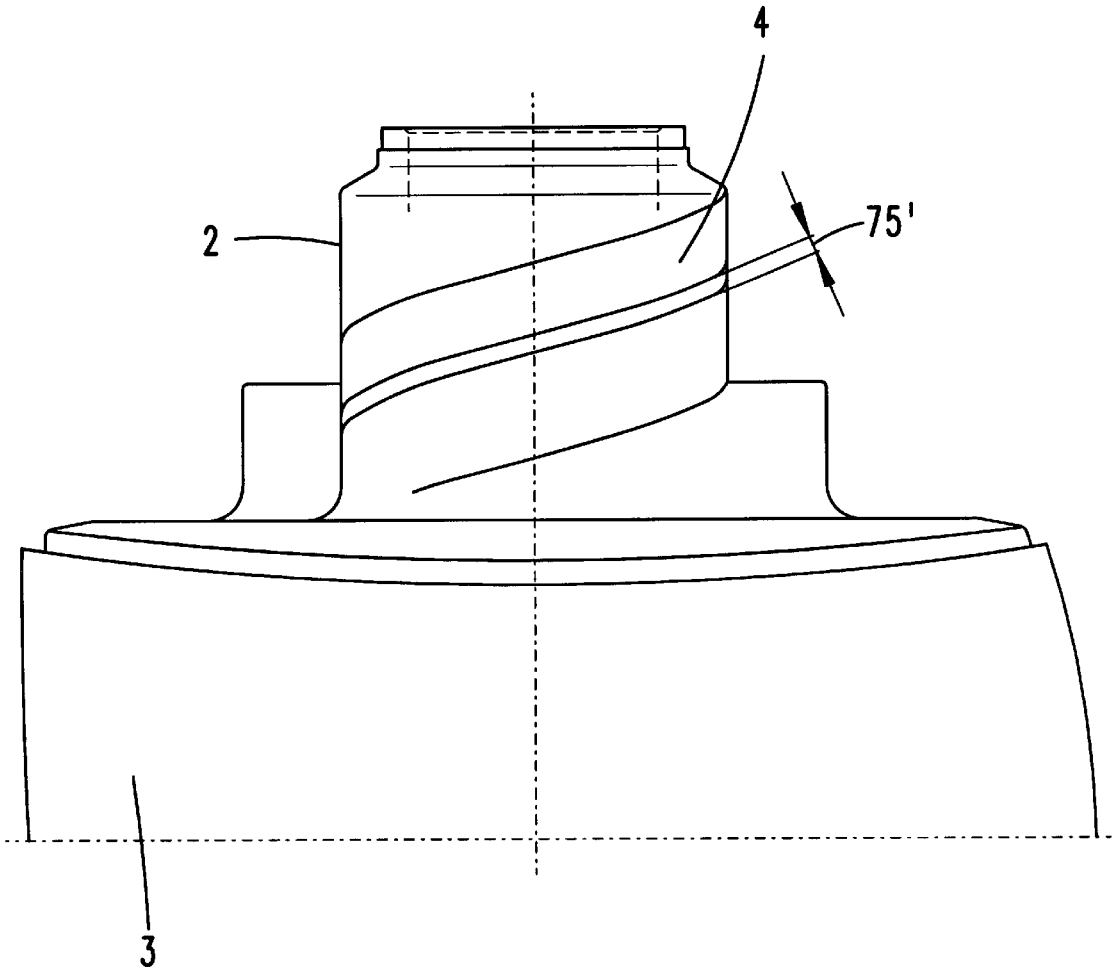
FIG. 46 shows the bottle container looking towards the broad side thereof.
Figure 47:
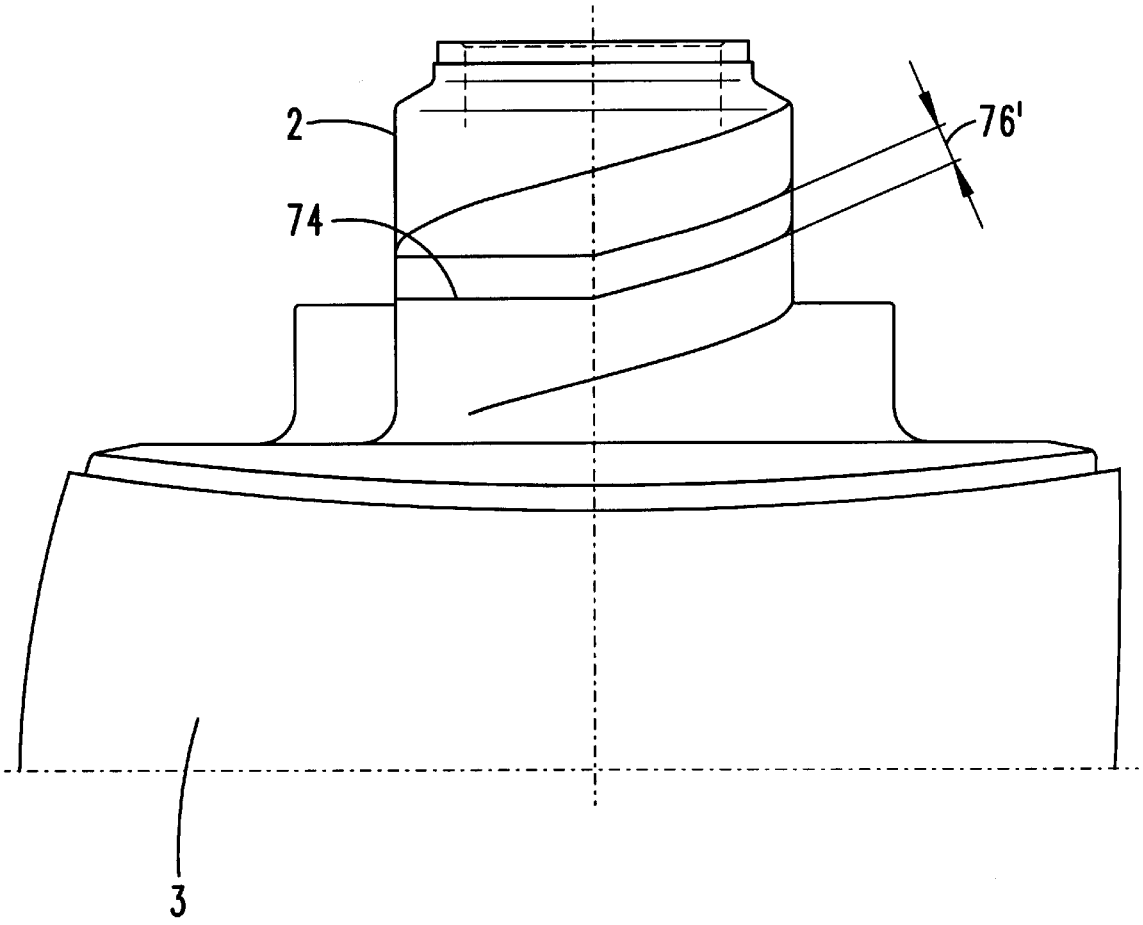
FIG. 47 shows a corresponding view towards the other broad side.
Figure 48:
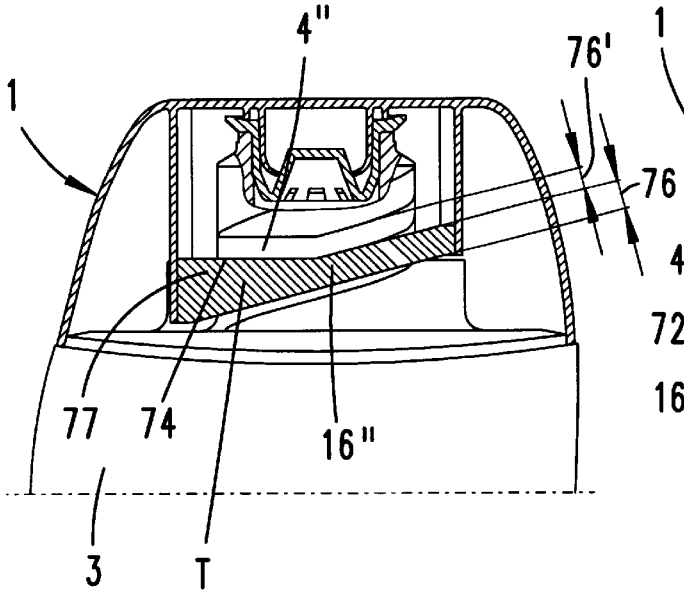
FIGS. 48 to 50 show permissible pairing positions of the closure.

The contents of the invention outlined at the beginning was generally based on a basic symmetry of the closures V interacting with bottle containers 3. Accordingly, the twisting-on positioning is of random character there, i.e. the closure V can be fitted both in a 0° position and in a position rotated 180° therefrom. In each case, the visual closed form of closure V and container 3 is achieved. The last-described version is intended to make it possible to enable the pairing-matched docking in the case of asymmetries. There is therefore just one fixed position here for the equidistance of the contours of the closure V and container 3, which no longer exists the other way round, for example in the case of a 180° rotation. This results in the requirement of perfecting the structural form in such a manner that the closure-container pairing is permitted in only one position ensuring the equidistance of the contours. All positionings deviating therefrom are inevitably blocked. In the following, further details of the constructional relationships will be gone into: a comparison of FIGS. 42 and 43 shows, for example, that the height 75 of the band or of the section 16' is greater than the height 76 of the band or section 16" of the ring R in FIG. 43. The difference in height H is seen in FIG. 41. Furthermore, the band or the section 16" has an approximately horizontal upper flank 77 extending from the central plane. The upper flank 77 interacts with the horizontal collar 74. The following structures are present on the bottle container 3: the vertical threaded profile surfaces or ridges have the heights 75' and 76' (cf. FIG. 45). The height 76' is visibly larger than the height 75'. Whereas the height 75' runs continuously (cf. FIG. 46), the threaded element or latching projection 4" undergoes, approximately from the center, a horizontal development in the form of the horizontal collar 74 which has been discussed.

Closure twisting-off from a 0° position (FIGS. 48–50): in this closure initial position before the twisting-off, the coding remains ineffective. The height 76 engages without any problem below the threaded profile element of the height 76'. The horizontal continuation of the lower threaded profile flank of the bottle container 3—approximately from the centre—is followed by the horizontal upper flank 77 of the closure ring R, specifically likewise approximately from the central plane (reference should be made to FIG. 48). This configuration can also be seen at the same time in FIG. 49.

Figure 49:
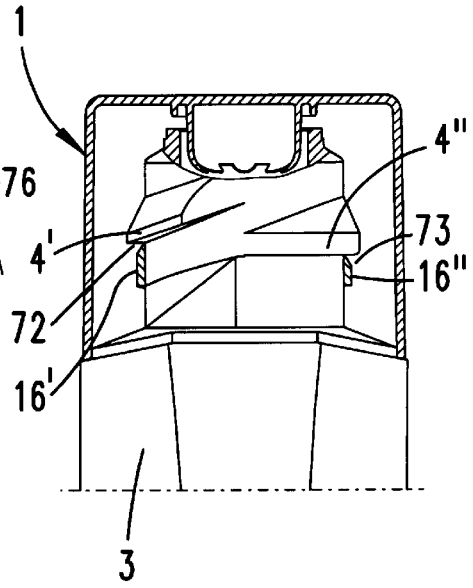
Figure 50:
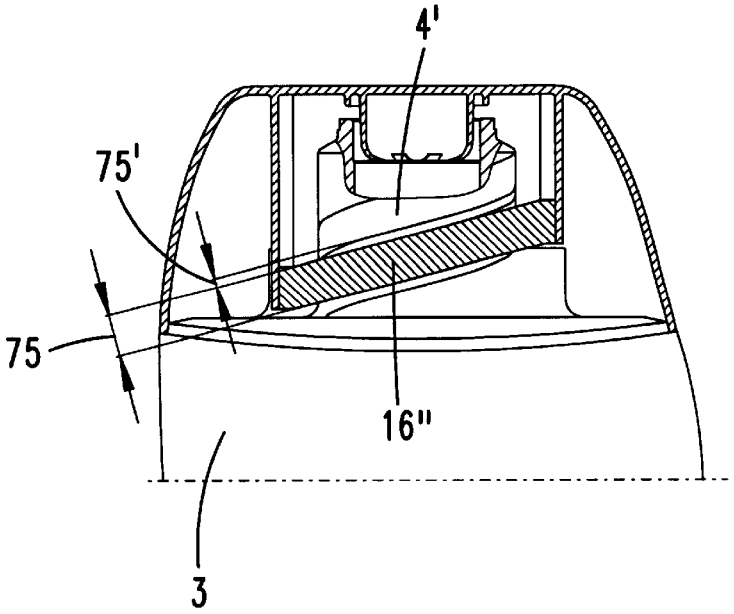

The secure underhooking of the ring R is shown at the location forming the undergripping space 73. FIG. 50 shows the opposite side of the pairing. The engagement of the ring R or of the section of the height 75 under the threaded profile flank of the bottle container 3 of the height 75' is illustrated here. FIG. 49 shows this engagement situation at the location forming the undergripping space 72.

Figure 51:
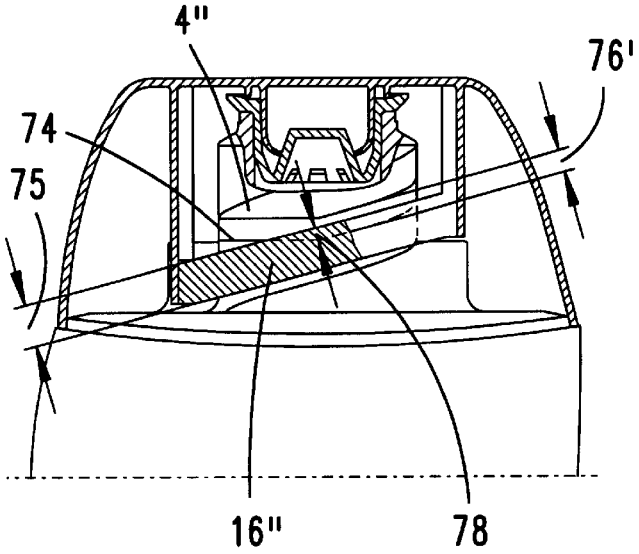
FIGS. 51 to 53 show impermissible pairing positions of the closure.
Figure 52:
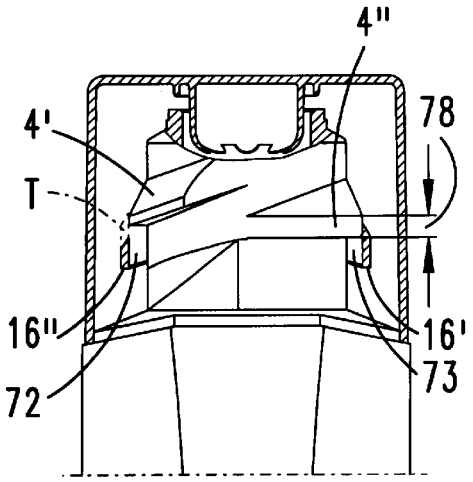
Figure 53:
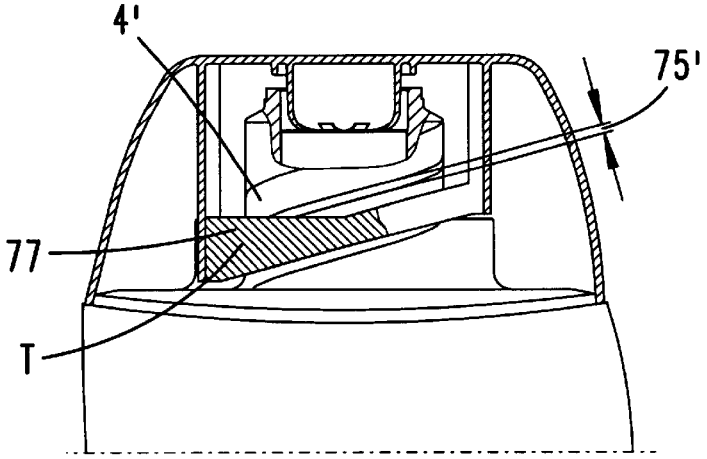

Closure twisting-off from a starting position offset with respect to the 0 position by about 180° (FIGS. 51–53).

In this closure initial position before the twisting-off, the coding is effective.

Between the height 75 and the threaded profile height 76', there exists an amount of overlap of a height 78, which does not permit the section 16" there of the ring R to hook under it. On the opposite side, the horizontal continuation, i.e. the part T, prevents hooking under the threaded profile flank guided at the ascending angle, i.e. the height 75'. There is here in question the region of the undergripping space 72.

Latching of the closure V and bottle container 3 is not possible in this combination position. Unlatching or springing up of the closure is consequently likewise not possible.

However, the closure V remains rotatable and passes after an approximately 180° rotation into the 0° position, whereupon a positive underhooking pairing of the closure latching band with the container threaded-profile flanks is again possible.

I claim:

1. Closure cap (1) interacting with a bottle container (3), a latching projection (4) being provided on the bottle container (3) and a latching arm (5) being provided on the closure cap (1) together with an undergripping projection (12) for interacting with the latching projection (4), wherein the undergripping projection (12) is provided on a circumferentially encircling ring (R) which, in the circumferential direction, has a length store (L) which is sufficient to overrun the latching projection (4) and is useable with elastic resetting, said circumferentially encircling ring (R) forms, on its upper side, the undergripping projection.

2. Closure cap together with a bottle container according to claim 1, wherein the latching projection (4) is provided on a bottle neck (2) having a discharge opening (14), and the latching arm (5) runs substantially parallel to a central axis (x—x) of the discharge opening (14).

3. Closure cap together with a bottle container according to claim 1, wherein two substantially mutually opposite latching arms (5) are provided.

4. Closure cap together with a bottle container according to claim 1, wherein the length store (L) is provided by a resilient capability in a region of connection to the latching arm (5) of the ring (R).

5. Closure cap together with a bottle container according to claim 1, wherein the ring (R) runs substantially perpendicularly with respect to the latching arm (5).

6. Closure cap together with a bottle container according to claim 1, wherein said latching arm comprises at least two latching arms and the ring (R) runs substantially perpendicularly with respect to the at least two latching arms.

* * * * *

UNITED STATES PATENT AND TRADEMARK OFFICE

CERTIFICATE OF CORRECTION

PATENT NO. : 6,609,637 B1
DATED : August 26, 2003
INVENTOR(S) : Udo Suffa

It is certified that error appears in the above-identified patent and that said Letters Patent is hereby corrected as shown below:

Title page,
Item [73], Assignee, change "Weke" to -- Werke --

Signed and Sealed this

Twenty-fifth Day of May, 2004

JON W. DUDAS
*Acting Director of the United States Patent and Trademark Office*